US011840364B2

(12) United States Patent
Franz et al.

(10) Patent No.: US 11,840,364 B2
(45) Date of Patent: Dec. 12, 2023

(54) PACKAGING MACHINE FOR PACKAGING PORTIONED PRODUCTS WHICH ARE LIQUID OR PASTY IN THE PROCESSING STATE

(71) Applicant: Benhil GmbH, Neuss (DE)

(72) Inventors: Maik Franz, Mönchengladbach (DE); Joachim Haupt, Cologne (DE)

(73) Assignee: Benhil GmbH, Neuss (DE)

( * ) Notice: Subject to any disclaimer, the term of this patent is extended or adjusted under 35 U.S.C. 154(b) by 147 days.

(21) Appl. No.: 17/290,313

(22) PCT Filed: Oct. 8, 2019

(86) PCT No.: PCT/EP2019/000290

§ 371 (c)(1),
(2) Date: Apr. 30, 2021

(87) PCT Pub. No.: WO2020/088788

PCT Pub. Date: May 7, 2020

(65) Prior Publication Data

US 2021/0403187 A1 Dec. 30, 2021

(30) Foreign Application Priority Data

Oct. 30, 2018 (DE) ..... 10 2018 008 483.4

(51) Int. Cl.
*B65B 11/42* (2006.01)
*B65B 25/06* (2006.01)
(Continued)

(52) U.S. Cl.
CPC ..... *B65B 11/42* (2013.01); *B65B 11/32* (2013.01); *B65B 25/06* (2013.01); *B65B 29/00* (2013.01);
(Continued)

(58) Field of Classification Search
CPC ..... B65B 11/004; B65B 11/28; B65B 11/32; B65B 11/36; B65B 11/42; B65B 11/46;
(Continued)

(56) References Cited

U.S. PATENT DOCUMENTS 467,040 A * 1/1892 Mellen ..... B65B 1/04 493/236
688,488 A * 12/1901 Rose ..... B65B 11/10 53/233
(Continued)

FOREIGN PATENT DOCUMENTS

DE 3816970 A1 * 5/1988 ..... B65B 3/10
DE 69121570 T2 1/1997
(Continued)

OTHER PUBLICATIONS

International Search Report, with English translation, issued in corresponding International Application No. PCT/EP2019/000290 dated Feb. 7, 2020 (7 pages).
(Continued)

*Primary Examiner* — Joshua G Kotis
(74) *Attorney, Agent, or Firm* — FLYNN THIEL, P.C.

(57) ABSTRACT

A method for packaging products, wherein packaging material web is transported in direction of an upwardly open pair of folding claws, is cut to length while forming a planar blank of the wrapper, and the blank is positioned above the folding claws, wherein the product is metered, the product portion is pre-shaped, and the blank by placing thereon the pre-shaped product portion is folded into the claws while forming the upwardly open wrapper. Thereafter, the upward-projecting lateral longitudinal peripheries of the wrapper are folded inward onto the product portion, whereupon the transverse peripheries of the wrapper which extend perpendicular thereto are folded inward onto the product portion. The lateral longitudinal peripheries and transverse periph-
(Continued)

eries of the wrapper are folded inward onto the product portion and are simultaneously connected to one another, while the wrapper provided with the product portion is still situated in the pair of folding claws.

8 Claims, 12 Drawing Sheets

(51) Int. Cl.

| | |
|---|---|
| ***B65B 49/08*** | (2006.01) |
| ***B65B 61/06*** | (2006.01) |
| ***B65B 11/32*** | (2006.01) |
| ***B65B 41/10*** | (2006.01) |
| ***B65B 29/00*** | (2006.01) |

(52) U.S. Cl.
CPC ..... *B65B 41/10* (2013.01); *B65B 49/08* (2013.01); *B65B 61/06* (2013.01)

(58) Field of Classification Search
CPC ..... B65B 11/48; B65B 11/54; B65B 3/02; B65B 3/025; B65B 3/32; B65B 25/06; B65B 49/08; B65B 41/10; B65B 41/04; B65B 61/06
See application file for complete search history.

(56) References Cited

U.S. PATENT DOCUMENTS

| | | | | | |
|---|---|---|---|---|---|
| 787,379 | A * | 4/1905 | Hopkins | B65B 11/28 | 53/372.6 |
| 1,084,593 | A * | 1/1914 | De Escobales | B65B 11/42 | 53/225 |
| 1,543,296 | A * | 6/1925 | Peters | B65B 11/40 | 53/389.5 |
| 1,653,880 | A * | 12/1927 | Smith | B65B 11/28 | 53/225 |
| 2,225,888 | A * | 12/1940 | Rose | B65B 19/22 | 53/229 |
| 2,592,793 | A | 4/1952 | Coon, Sr. et al. | | |
| 2,600,216 | A * | 6/1952 | Denison | B65B 9/06 | 53/410 |
| 3,375,636 | A * | 4/1968 | Redmond | B65B 25/06 | 426/414 |
| 4,078,363 | A * | 3/1978 | Ranzi | B65B 11/54 | 53/228 |
| 4,352,264 | A * | 10/1982 | Seragnoli | B65B 11/28 | 53/201 |
| 4,388,796 | A * | 6/1983 | Zelnick | B65B 11/54 | 53/390 |
| 4,887,408 | A * | 12/1989 | Mattei | B29C 65/18 | 53/412 |
| 5,273,188 | A | 12/1993 | Sanino | | |
| 5,794,411 | A * | 8/1998 | Combs | B65B 11/16 | 53/223 |
| 6,035,612 | A * | 3/2000 | Draghetti | B65B 11/42 | 53/201 |
| 7,090,630 | B2 * | 8/2006 | Boldrini | B31B 50/64 | 493/51 |
| 7,966,788 | B2 | 6/2011 | Rütter | | |
| 9,073,653 | B2 * | 7/2015 | Cavazza | B65B 11/32 | |
| 11,142,358 | B2 * | 10/2021 | Schubert | B65B 11/12 | |
| 2014/0083055 | A1 * | 3/2014 | Rodrigues | B65B 51/146 | 53/465 |

FOREIGN PATENT DOCUMENTS

| | | | | |
|---|---|---|---|---|
| DE | 102008020604 | A1 | 11/2009 | |
| DE | 102009037667 | A1 | 2/2011 | |
| DE | 102012014951 | B3 * | 11/2013 | B29C 65/18 |
| DE | 102012014951 | B3 | 11/2013 | |
| EP | 0539646 | B1 | 5/1993 | |
| EP | 0733548 | A1 | 9/1996 | |
| EP | 1772378 | A1 * | 4/2007 | B65B 11/28 |
| EP | 2112069 | A1 | 10/2009 | |
| JP | S6217503 | U | 2/1987 | |
| JP | S63272617 | A | 11/1988 | |
| JP | H10129686 | A | 5/1998 | |
| WO | 00/61436 | A1 | 10/2000 | |

OTHER PUBLICATIONS

Written Opinion of International Searching Authority issued in corresponding International Application No. PCT/EP2019/000290 dated Feb. 7, 2020 (6 pages).
German Search Report issued in corresponding German Application No. 10 2018 008 483.4, dated Sep. 9, 2019 (3 pages).
Office Action issued in corresponding Japan Application No. 2021-523238, dated Apr. 18, 2023 (10 pages).

* cited by examiner

PACKAGING MACHINE FOR PACKAGING PORTIONED PRODUCTS WHICH ARE LIQUID OR PASTY IN THE PROCESSING STATE

FIELD OF THE INVENTION

The invention relates to a method for packaging portioned products which are liquid or pasty at least in the processing state in a wrapper that is cut to length from at least one packaging material web, wherein the packaging material web is transported in the direction of at least one upwardly open pair of folding claws, is cut to length while forming a substantially planar blank of the wrapper, and the blank is positioned above the pair of folding claws, wherein the product is metered, the product portion is pre-shaped, and the blank by placing thereon the pre-shaped product portion is folded into the pair of folding claws while forming the upwardly open wrapper, whereupon the upward-projecting lateral longitudinal peripheries of the upwardly open wrapper are folded inward onto the pre-shaped product portion, and whereupon the transverse peripheries of the wrapper which extend so as to be substantially perpendicular to the lateral longitudinal peripheries of said wrapper are folded inward onto the pre-shaped product portion. The invention furthermore relates to a packaging machine, particularly suitable for carrying out such a method, for packaging portioned products which are liquid or pasty at least in the processing state in a wrapper that is cut to length from at least one packaging material web, comprising

- at least one metering installation which is configured for metering a product portion of the product which is liquid or pasty at least in the processing state;
- at least one pre-shaping installation which is integrated in the metering installation or disposed downstream of the latter, and which is configured for pre-shaping the metered product portion so as to form a pre-shaped product portion;
- at least one transport installation which is configured for transporting at least one packaging material web in the direction of the pre-shaping installation;
- at least one cutting installation which is assigned to the transport installation and in the transporting direction thereof is disposed upstream of the pre-shaping installation and which is configured for cutting to length a substantially planar blank of a wrapper from the packaging material web;
- at least one upwardly open pair of folding claws which are assigned to the pre-shaping installation and disposed downstream of the cutting installation;
- at least one guiding installation which is configured for transferring the substantially planar blank of the wrapper that by means of the cutting installation has been cut to length from the packaging material web to a position above the pair of folding claws;
- at least one first folding station which is configured for folding the lateral longitudinal peripheries of the upwardly open wrapper provided with a pre-shaped product portion inward onto the pre-shaped product portion; and
- at least one second folding station which is disposed downstream of the first folding station and is configured for folding the transverse peripheries of the wrapper which extend so as to be substantially perpendicular to the lateral longitudinal peripheries of said wrapper inward onto the pre-shaped product portion.

BACKGROUND AND SUMMARY

Methods of this type for packaging portioned products which are liquid or pasty at least in the processing state in a wrapper that is cut to length from a packaging material web, as well as packaging machines suitable for carrying out said methods, are known and are widely used in particular for packaging portions of foodstuffs which are liquid to more or less pasty at least in the processing state, such as for example butter, margarine, pasty fats, processed and fresh cheese, chocolate, soup pastes, and the like. The typical procedure here is such that planar blanks are first cut to length from a packaging material web that by means of a transport installation is transported to a cutting installation, whereupon the blank is transferred to a folding duct in which said blank by means of a folding ram is folded inward while forming the upwardly open wrapper. The desired product portion which has been metered by means of a metering installation is then placed onto the wrapper folded in the folding duct, said product portion being able to be placed into the folding duct already pre-shaped by means of a pre-shaping installation, such as in the form of a product-forming duct, for example, that is assigned to the metering installation, or placed into the folding duct in the pasty state so as to be pre-shaped in the latter. Finally, the upward-projecting lateral longitudinal peripheries of the upwardly open wrapper are folded inward onto the pre-shaped product portion, whereupon the transverse peripheries of the wrapper which extend so as to be substantially perpendicular to the lateral longitudinal peripheries of said wrapper are folded inward onto the pre-shaped product portion. Such a method, as well as a packaging machine suitable for carrying out said method, is known from DE 10 2008 020 604 B1, for example.

In many cases it is desirable for the pasty products to be packaged in a more or less air-tight manner, so as to protect the packaged product which in most instances is perishable against brief oxidative incursions and to meet hygienic requirements. For this purpose, DE 10 2012 014 951 B1, for example, describes a method for packaging portioned products which are liquid or pasty at least in the processing state in a wrapper that is cut to length from a packaging material web in that the product is metered in a metering installation and is pre-shaped in a product-forming duct of the metering installation, whereupon the pre-shaped product portion by means of a product ejector ram which is guided in the product-forming duct is placed onto the central region between the lateral longitudinal peripheries of the packaging material web which is guided along below the product-forming duct. The packaging material web having the pre-shaped product portion is thereafter transported to a first folding station at which the lateral longitudinal peripheries of the packaging material web are folded upward onto the lateral faces of the product portion as well as inward onto the upper side of the product portion. The packaging material web which is transported onward and which now encloses a respective product portion in an approximately tubular manner, downstream of the first folding station, reaches a first connecting station at which the free ends of the packaging material web are sealed or adhesively bonded to one another by means of one or a plurality of pairs of sealing rollers. The packaging material web which is transported onward and which now encloses a respective product portion in a more or less unreleasable and approximately tubular manner, downstream of the first connecting station, in turn reaches a second folding station at which the packaging material of the packaging material web is in each case folded between two successive pre-shaped product portions onto the transverse peripheries of the packaging material web, this taking place by means of folding jaws which are able to be moved in a reciprocating manner perpendicularly to the plane of the packaging material web and which along portions are conjointly moved in a synchronized manner with the packaging material web. The second folding station herein can be configured as a second folding and connecting station so as to peripherally seal or adhesively bond to one another the transverse peripheries of the packaging material web conjointly with the folding procedure. The product portions which are now completely packaged and finally separated from one another are downstream of the second folding and connecting station, in that the packaging material web by means of a cutting installation is cut to length while in each case forming the finished wrapper packaging between successive packaged product portions.

While the known method, or the packaging machine serving for carrying out said method, respectively, has in principle been successful in practice and enable high cycle rates, one disadvantage lies in particular in a relatively complex construction which requires in particular a large installation space. Moreover, it has proven to be comparatively complex to ensure a more or less entirely gas-tight, in particular air-free, packaging, respectively, by means of the known packaging machine, because it is very difficult for residual air which, predominantly by virtue of the transverse linear seals successively generated at the second folding and connecting station, is trapped in the packaging material to completely escape.

The same applies in an analogous manner to a method for packaging pasty products in a wrapper according to DE 10 2009 037 667 A1, which moreover requires an approximately cruciform blank of the wrapper which is interconnected along at least three different linear seals.

Further methods and devices for packaging portioned products into wrappers that are cut to length from packaging material webs can be derived from WO 00/61436 A1 and EP 0 733 548 A1, for example. A metering installation for foodstuffs which are liquid or pasty in the processing state is moreover known from EP 0 539 646 B1.

The invention is based on the object of refining a method and a packaging machine of the type mentioned at the outset, while guaranteeing faster cycle rates and while at least largely avoiding the afore-mentioned disadvantages, in a simple and cost-effective manner so that a higher degree of compactness in comparison to the prior art, and in particular packaging of the product into the wrapper in a substantially entirely air-free manner, is guaranteed.

In terms of the method, this object in a method of the type mentioned at the outset is achieved in that at least the upward-projecting lateral longitudinal peripheries of the upwardly open wrapper are folded inward onto the pre-shaped product portion and simultaneously connected to one another, while the wrapper provided with the pre-shaped product portion is still situated in the pair of folding claws.

In terms of the device, the invention in a packaging machine of the type mentioned at the outset for achieving this object furthermore provides that at least the first folding station is configured as a first folding and connecting station and has two first folding and connecting tools which under a contact pressure are able to be converged and diverged, wherein the at least one pair of folding claws and the first folding and connecting station are able to be moved relative to one another to a first folding and connecting position in which the first folding and connecting station is situated directly above the pair of folding claws so as to, by relocating the first folding and connecting tools towards one another in a manner substantially parallel to the open upper side of the pair of folding claws, under a contact pressure fold the lateral longitudinal peripheries of the upwardly open wrapper provided with a pre-shaped product portion and situated in the pair of folding claws inward onto the pre-shaped product portion and simultaneously connect said lateral peripheries to one another.

The design embodiment according to the invention consequently makes it possible for at least the longitudinal peripheries of the wrapper which is folded into the at least one pair of folding claws and is cut to length from the packaging material web, to be folded inward onto the pre-shaped product portion and simultaneously connected to one another immediately after the product portion that has been metered by means of the metering installation and pre-shaped by means of the pre-shaping installation has been placed onto said wrapper, while the wrapper is still situated in the pair of folding claws such that the folding and connecting of the longitudinal peripheries for the purpose of applying a first connecting line which extends in the longitudinal direction takes place in a single operating cycle, and a separate, subsequent operating cycle for connecting the longitudinal peripheries of the wrapper to one another is as dispensable as any transportation to a separate connecting station required to this end. In terms of construction, the first folding and connecting tools of the first folding and connecting station serve to this end according to the invention, said first folding and connecting tools, by virtue of being able to be mutually converged under a contact pressure, being capable of folding the longitudinal peripheries of the wrapper onto the exposed upper side of the pre-shaped product portion as well as pressing said longitudinal peripheries onto one another along the peripheries and on account thereof connecting said longitudinal peripheries to one another. For this purpose, the at least one pair of folding claws and the first folding and connecting station are able to be moved relative to one another to a first folding and connecting position in which the first folding and connecting station is situated directly above the folding duct. The pair of folding claws according to the invention here is not configured as a circumferentially completely closed folding duct but comprises two approximately parallel folding claws, designed in the form of plates, for example, the blank of the wrapper positioned being folded into the intermediate space of said folding claws above the open cross section of the pair of folding claws by ejecting the pre-shaped product portion from the pre-shaping installation. By virtue of the open transverse sides of the pair of folding claws, the lateral longitudinal peripheries of the wrapper here can be simply folded inward onto the pre-shaped product portion and simultaneously be connected to one another, because the wrapper possesses only an approximately U-shaped design when said wrapper has been folded into the pair of folding claws, such that the longitudinal sides of said wrapper that are to be connected to one another are mutually aligned in an entirely parallel manner.

In one advantageous design embodiment it can be provided that the upward-projecting lateral longitudinal peripheries of the upwardly open wrapper which are folded inward as well as the transverse peripheries of the wrapper which extend so as to be substantially perpendicular to the lateral longitudinal peripheries of said wrapper are in each case folded inward onto the pre-shaped product portion and simultaneously connected to one another, while the wrapper provided with the pre-shaped product portion is still situated in the pair of folding claws.

In terms of the device, a packaging machine according to the invention for this purpose is preferably distinguished in that the second folding station is configured as the second folding and connecting station and has in each case two second folding and connecting tools which are disposed on the opposite open transverse sides of the pair of folding claws and under a contact pressure are able to be converged and diverged, wherein the at least one pair of folding claws and the second folding and connecting station are able to be moved relative to one another to a second folding and connecting position in which the pair of folding claws that are open in the direction of the two transverse sides of the pre-shaped product portion situated in the pair of folding claws are situated in the interior of the second folding and connecting station so as to fold in each case the lateral transverse peripheries of the wrapper situated in the pair of folding claws and provided with a pre-shaped product portion inward onto the pre-shaped product portion and simultaneously connect said lateral transverse peripheries to one another.

In this way it is possible to not only fold the longitudinal peripheries of the wrapper that are folded into the at least one pair of folding claws inward onto the pre-shaped product portion and simultaneously connect said longitudinal peripheries to one another while the wrapper is still situated in the pair of folding claws, but also the two transverse peripheries of said wrapper that extend in each case substantially perpendicular to the lateral longitudinal peripheries of the wrapper that have already been connected to one another, wherein the folding of the two respective transverse peripheries inward onto the preshaped product portion, as well as connecting the two respective transverse peripheries to one another, again takes place in a single operating cycle as long as the wrapper impinged with the pre-shaped product portion is still situated in the pair of folding claws.

In terms of construction, the second folding and connecting tools of the second folding and connecting station serve to this end according to the invention, said second folding and connecting tools potentially being designed so as to be similar to those of the first folding and connecting station, but being able to be converged and diverged in a direction of movement which is perpendicular in relation to the pre-shaped production portion. By virtue of the second folding and connecting tools also being able to be converged under a contact pressure, said second folding and connecting tools are capable of folding the respective transverse peripheries of the wrapper onto the two opposite transverse sides of the preshaped product portion as well as pressing said transverse peripheries onto one another along the peripheries and, on account thereof, connecting said transverse peripheries to one another in the region of both ends of the first connecting line of the lateral longitudinal peripheries of the wrapper that are applied at the first folding and connecting station. For this purpose, the at least one pair of folding claws and the second folding and connecting station are able to be moved relative to one another to a second folding and connecting position in which the pair of folding claws is situated in the interior of the second folding and connecting station, that is to say having the open transverse sides between the two pairs of second folding and connecting tools which are in each case able to be converged and diverged. It can prove particularly advantageous here for the two pairs of second folding and connecting tools to be converged and pressed against one another in a synchronous manner when folding and connecting the respective transverse peripheries of the wrapper, such that the two transverse peripheries of the wrapper are simultaneously connected to one another on both sides with what is now an entirely closed wrapper packaging, so that any potential residual air in the interior of the wrapper can completely escape and a more or less air-tight or gas-tight, respectively, wrapper packaging is generated.

As has already been indicated, it can be provided in one advantageous design embodiment for transferring the at least one pair of folding claws at least from the first folding and connecting station to the second folding and connecting station that in the first folding and connecting station the upward-projecting lateral longitudinal peripheries of the upwardly open wrapper first are folded inward onto the pre-shaped product portion and simultaneously connected to one another, whereupon the pair of folding claws, conjointly with the wrapper situated therein and provided with the pre-shaped product portion, the longitudinal peripheries of said wrapper already having been connected to one another, is transferred, in particular along a substantially arcuate track curve, to the second folding and connecting station at which the transverse peripheries of the wrapper which extend so as to be substantially perpendicular to the lateral longitudinal peripheries of said wrapper are in each case folded inward onto the pre-shaped product portion and simultaneously connected to one another.

In terms of the device, it can be advantageously provided for this purpose that the at least one pair of folding claws is disposed on the external circumference of a rotatingly driven folding wheel, wherein the first folding and connecting station and the second folding and connecting station are disposed on different circumferential regions of the folding wheel such that by rotating the at least one pair of folding claws, in particular in a cycled manner, the wrapper folded therein, conjointly with the pre-shaped product portion, can be transported from the first folding and connecting station to the second folding and connecting station. The two folding claws of the pair of folding claws here extend expediently perpendicularly to the direction of rotation of the folding wheel, thus substantially in the axial direction of the latter, so as to entrain the wrapper folded therein, conjointly with the product portion received therein, in the direction of rotation of the folding wheel so that the open transverse sides of the pair of folding claws point in each case in the direction of the axial ends of the folding wheel.

In order to ensure very high cycle rates, a plurality of pairs of folding claws can preferably be disposed on different circumferential regions of the folding wheel in this case, wherein the circumferential spacing between two neighbouring pairs of folding claws corresponds to the circumferential spacing between the first folding and connecting station and the second folding and connecting station which are disposed on different circumferential regions of the folding wheel, as has already been mentioned. In this way, a wrapper folded into one of the pairs of folding claws at the first folding and connecting station, for example, can be provided with the first connecting line of the lateral longitudinal peripheries that extends in the longitudinal direction, while a wrapper which is folded into a further pair of folding claws and which has already passed through this operating cycle and has been transferred to the second folding and connecting station by rotating the folding wheel, can simultaneously be provided with the two connecting lines of the respective transverse peripheries of said wrapper that extend in the transverse direction.

While the metering installation having the pre-shaping installation assigned thereto can in principle also be disposed so as to be upstream of the first folding and connecting station, for example in particular again on a circumferential region of the folding wheel, the circumferential spacing thereof from the first folding and connecting station corresponding to the circumferential spacing between two neighbouring pairs of folding claws of the folding wheel, the pre-shaping installation, in particular the metering installation as well as the pre-shaping installation, can be preferably disposed on the same circumferential region of the folding wheel as the first folding and connecting station such that the pre-shaped product portion can be placed onto the wrapper by means of the pre-shaping installation, and the lateral longitudinal peripheries of the wrapper by means of the first folding and connecting station are then immediately thereafter folded inward and connected to one another without having to rotate the folding wheel, on account of which a very high degree of compactness of the packaging machine can be ensured at very high cycle rates.

When folding the transverse peripheries of the wrapper onto the pre-shaped product portion, it can furthermore prove advantageous for the two opposite peripheral portions of the wrapper that are situated between the transverse peripheries of said wrapper to be first in each case folded inward in a substantially triangular shape onto the product portion, whereupon the transverse peripheries are in each case folded outward onto the peripheral portions of the wrapper that have been folded inward in a substantially triangular shape, and the transverse peripheries are connected to one another.

In terms of the device, it can be provided for this purpose that the second folding and connecting station furthermore has in each case two third folding tools which are in each case able to be converged and diverged in a direction which is parallel to the respective plane of movement of the second folding and connecting tools but substantially perpendicular to the direction of movement of the latter so as to, when folding the transverse peripheries of the wrapper onto the pre-shaped product portion and connecting these transverse peripheries to one another by means of the second folding and connecting tools, first fold in each case inward in a substantially triangular shape the two opposite peripheral portions of the wrapper that are situated between the transverse peripheries of the latter onto the product portion and thereafter by means of the second folding and connecting tools fold in each case the transverse peripheries of the wrapper outward onto the peripheral portions of the wrapper that have been folded inward in a substantially triangular shape and simultaneously connect said transverse peripheries to one another. The peripheral portions of the wrapper that are situated between the respective transverse peripheries of the wrapper that have to be connected to one another, by means of the third folding tools, can thus first be folded outward onto the pre-shaped product portion such that said peripheral portions in the finished wrapper packaging are situated on the inside of the transverse peripheries of the wrapper that are subsequently connected to one another by means of the second folding and connecting tools. Third folding tools of this type are known per se from DE 10 2012 014 951 B1 cited at the outset, and therein referred to as "indenting installation".

The longitudinal peripheries of the wrapper that are folded inward onto the preshaped product portion and/or the transverse peripheries of the wrapper that extend so as to be substantially perpendicular to the lateral longitudinal peripheries of the wrapper and are folded inward onto the pre-shaped product portion can thus, when folded inward, preferably be simultaneously connected to one another in that said peripheries are sealed, in particular cold-sealed, or adhesively bonded to one another.

In terms of device, the first folding and connecting tools of the first folding and connecting station and/or the second folding and connecting tools of the second folding and connecting station can consequently be preferably formed by sealing tools, in particular cold-sealing tools.

If the product to be packaged is a product which is largely insensitive to the temperature, a packaging material web which is provided with a hot-seal-capable coating or impregnation can be used, for example, the wrapper cut to length from said packaging material web being hot-sealed by means of the first folding and connecting tools of the first folding and connecting station and/or by means of the respective second folding and connecting tools of the second folding and connecting station. In this case, the first and/or second folding and connecting tools are able to be heated so as to generate a longitudinal linear seal and/or in each case a transverse linear seal by pressing said tools against one another. However, if the product to be packaged is a temperature-sensitive product as is the case in particular with the foodstuffs listed in an exemplary manner at the outset, a packaging material web which has been provided with a pattern of cold-sealing lacquer or adhesive according to the envisaged connecting lines can preferably be used, for example, such that the wrapper that is cut to length from the packaging material web can be cold-sealed or adhesively bonded to one another by means of the first folding and connecting tools of the first folding and connecting station and/or by means of the respective second folding and connecting tools of the second folding and connecting station in that the respective folding and connecting tools are converged in the non-temperature-controlled state only by way of a contact pressure so as to cold-seal, or adhesively bond, respectively, the peripheral regions of the wrapper that are provided with the cold-seal lacquer or adhesive, respectively.

If desired, the wrapper which is situated in the folding duct and is provided with the pre-shaped product portion can be kept in an inert gas atmosphere at least while the longitudinal peripheries of said wrapper and/or expediently also when the transverse peripheries of said wrapper are connected to one another such that an enhanced protection of the product against oxidation as a result of contact with oxygen in the air is guaranteed. In a corresponding packaging machine, it can be provided for this purpose that at least the first folding and connecting station and/or preferably also the second folding and connecting station is disposed in an inert gas atmosphere.

As has already been indicated, according to a first variant of the method it can be provided that the product which is liquid or pasty at least in the processing state is pre-shaped in a product-forming duct, whereupon the pre-shaped product portion, for example by means of a product ejector ram which is guided so as to be displaceable in the product-forming duct, for example, is transferred to the pair of folding claws and, when the pre-shaped product portion is transferred from the product-forming duct to the pair of folding claws, the substantially planar blank of the wrapper that is positioned in an intermediate space between the product-forming duct and the pair of folding claws is simultaneously folded inward.

In a packaging machine suitable for carrying out such a first method variant, the pre-shaping installation can preferably have at least one product-forming duct having a product ejector ram which is configured for ejecting the pre-shaped product portion into the pair of folding claws, wherein the guiding installation is in particular disposed between the product-forming duct and the pair of folding claws so as to, when the product portion that has been pre-shaped in the product-forming duct by means of the product ejector ram is ejected from the product-forming duct into the pair of folding claws, simultaneously fold the blank of the wrapper which by means of the guiding installation has been introduced into the intermediate space between the product-forming duct and the pair of folding claws into the pair of folding claws. The pre-shaping installation having the at least one product-forming duct in this case can in particular be integrated in the metering installation such that the metering volume is predefined by the volumetric capacity of the product-forming duct, wherein this metering volume may preferably be variable by setting the product ejector ram in relation to the product-forming duct.

According to a second embodiment it can instead be provided that the product which is liquid or pasty at least in the processing state is pre-shaped in a forming nozzle, wherein the product portion is metered, squeezed through the forming nozzle and herein pre-shaped, cut off, and the pre-shaped product portion obtained herewith is transferred to the pair of folding claws. When the pre-shaped product portion is transferred from the forming nozzle to the pair of folding claws, the substantially planar blank of the wrapper that is positioned in an intermediate space between the forming nozzle and the pair of folding claws is again in particular simultaneously folded into the pair of folding claws.

In a packaging machine suitable for carrying out such a second method variant, the pre-shaping installation can consequently be formed by at least one forming nozzle which is configured for ejecting the pre-shaped product portion into the pair of folding claws, wherein the guiding installation is in particular disposed between the forming nozzle and the pair of folding claws so as to, when the product portion that has been pre-shaped in the forming nozzle is ejected into the pair of folding claws, simultaneously fold the blank of the wrapper which by means of the guiding installation has been introduced into the intermediate space between the forming nozzle and the pair of folding claws into the pair of folding claws. The pre-shaping installation having the at least one forming nozzle in this case can in particular be disposed downstream of the metering installation, wherein the metering installation can be formed by, for example, a volumetric metering unit such as an extruder, an extradition press, a hydraulic, pneumatic, hydro-pneumatic piston/cylinder unit or the like. Consequently, the product portion can be metered by correspondingly rotating the extruder screw according to a number of revolutions corresponding to the desired product portion, or by correspondingly repositioning the piston of the piston/cylinder unit according to a piston travel that corresponds to the desired product portion, be extruded or squeezed through the forming nozzle, respectively, and be pre-shaped hereby.

Both variants of embodiments here proved to be particularly favourable with a view to the fact that no folding ram for folding the blank that has been cut to length from the packaging material web, while forming a wrapper, has to be assigned to the pair of folding claws, but the blank can be folded into the folding duct by the product portion that has been pre-shaped by means of the product-forming duct or the forming nozzle of the extruder of the metering installation.

As far as the design embodiment of the guiding installation in terms of construction is concerned, it can be furthermore provided in one advantageous design embodiment that the guiding installation has at least one first pair of first guiding means which are disposed so as to be mutually parallel, as well as at least one second pair of second guiding means which are disposed so as to be mutually parallel, said guiding means being in each case potentially formed by guide plates, guide meshes, guide rods or the like which are disposed so as to be mutually parallel, for example, the substantially planar blank of the wrapper that by means of the cutting installation has been cut to length from the packaging material web being able to be received in the intermediate space of said guiding means and being able to be transferred to the pair of folding claws.

It can in particular be provided here that the first pair of the first guiding means directly adjoins the cutting installation that is disposed downstream of the transport installation of the packaging material web so as to receive therebetween the substantially planar blank of the wrapper that by means of the cutting installation has been cut to length from the packaging material web, and the second pair of the second guiding means adjoins the first pair of the first guiding means so as to guide onward the substantially planar blank of the wrapper from the first pair of the first guiding means to the second pair of the second guiding means, in particular from the intermediate space between the first pair of the first guiding means to the intermediate space of the second pair of the second guiding means, wherein the first pair of the first guiding means terminate at a position above the pair of folding claws, and the second pair of the second guiding means is able to be moved in a reciprocating manner between a first position, in which the second pair of the second guiding means adjoins the first pair of the first guiding means and in this way bridges the pair of folding claws, and a second position, in which the second pair of the second guiding means is disposed at a spacing from the first pair of the first guiding means that leaves vacant the open cross section of the pair of folding claws. A secure and reliable alignment of the substantially planar blank of the wrapper that is cut to length from the packaging material web so as to be central above the upwardly open pair of folding claws is ensured in this way, in that the two pairs of guiding means are converged so as to transfer the blank to the folding position thereof above the pair of folding claws (the second pair of the second guiding means in this first position bridges the open cross section of the pair of folding claws and preferably directly adjoins the first pair of the first guiding means), whereupon the second pair of the guiding means is diverged from the first pair so as to firmly hold the blank above the pair of folding claws, the periphery of said blank which is leading in the guiding direction then being situated in the intermediate space between the second pair of the second guiding means, while a trailing periphery of said blank is situated in the intermediate space between the first pair of the first guiding means (the second pair of the second guiding means in this position is disposed below a spacing from the first pair of the first guiding means, said spacing keeping vacant at least the open cross section of the pair of folding claws). The guiding installation moreover expediently comprises a propulsion installation such as, for example, one roller or a plurality of rollers which is/are driven in a controlled manner so as to transport the blank from the cutting installation to above the pair of folding claws.

In as far as the design embodiment of the first folding and connecting tools of the first folding and connecting station in terms of construction is concerned, it can in this context preferably be provided that one of the first folding and connecting tools is disposed on the first pair of the first guiding means of the guiding installation, preferably on the end thereof which is leading in the guiding direction and faces the pair of folding claws as well as the second pair of the second guiding means, and that the other of the first folding and connecting tools of the first folding and connecting station is disposed, in particular so as to be stationary, on the second pair of the second guiding means of the guiding installation that are able to be moved in a reciprocating manner, preferably on the end thereof which is trailing in the guiding direction and faces the pair of folding claws as well as the first pair of the first guiding means, such that said other of the first folding and connecting tools, conjointly with the second pair of the second guiding means of the guiding installation, is able to be converged with and diverged from the first folding and connecting tool.

BRIEF DESCRIPTION OF THE DRAWINGS

Further features and advantages of the invention are derived from the description hereunder of an exemplary embodiment with reference to the drawings in which.

DETAILED DESCRIPTION

Figure 1:
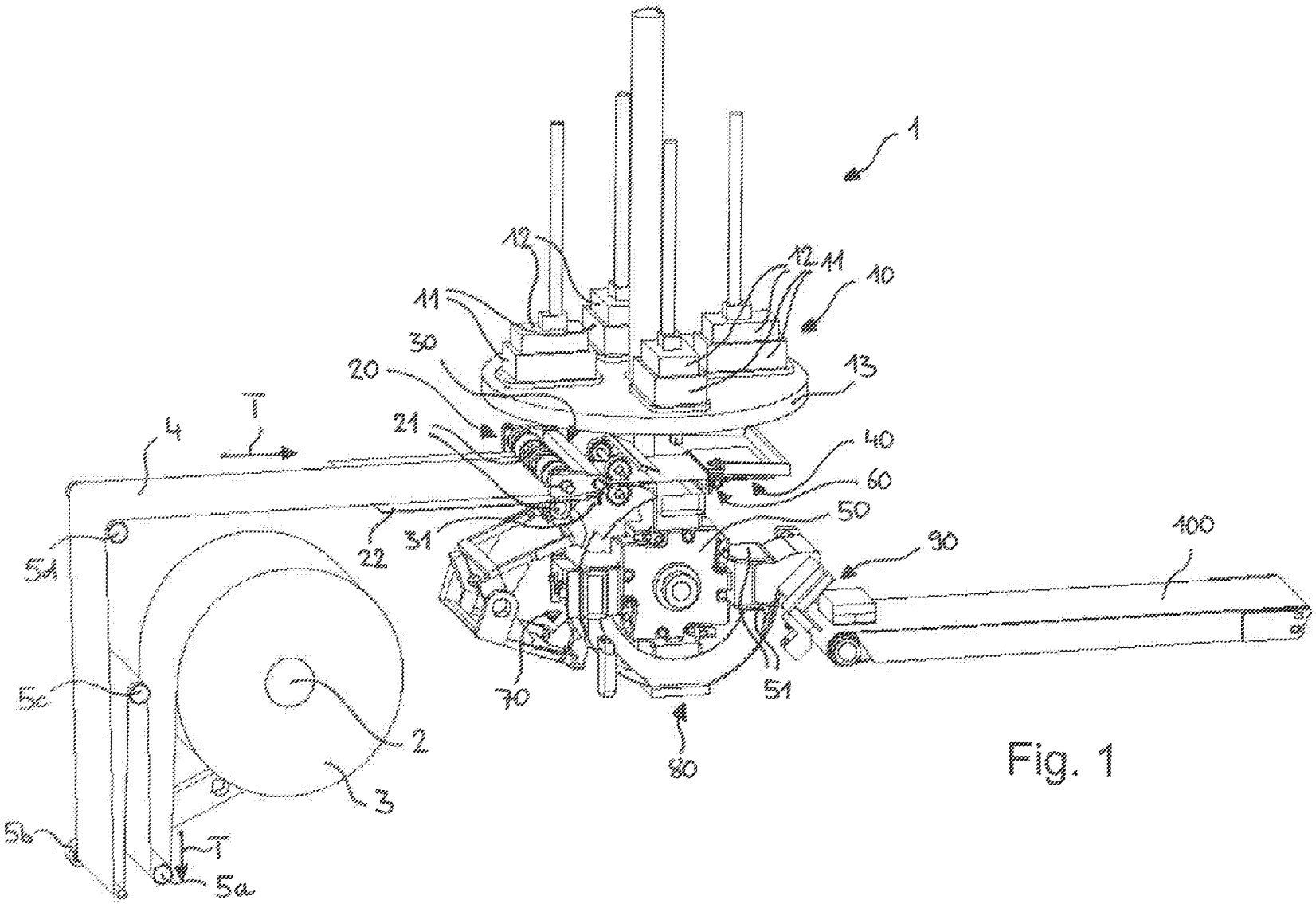
FIG. 1 shows a schematic perspective view of an embodiment of a packaging machine according to the invention for packaging portioned products which are liquid or pasty in the processing state in a wrapper which is cut to length from a packaging material web.
Figure 2:
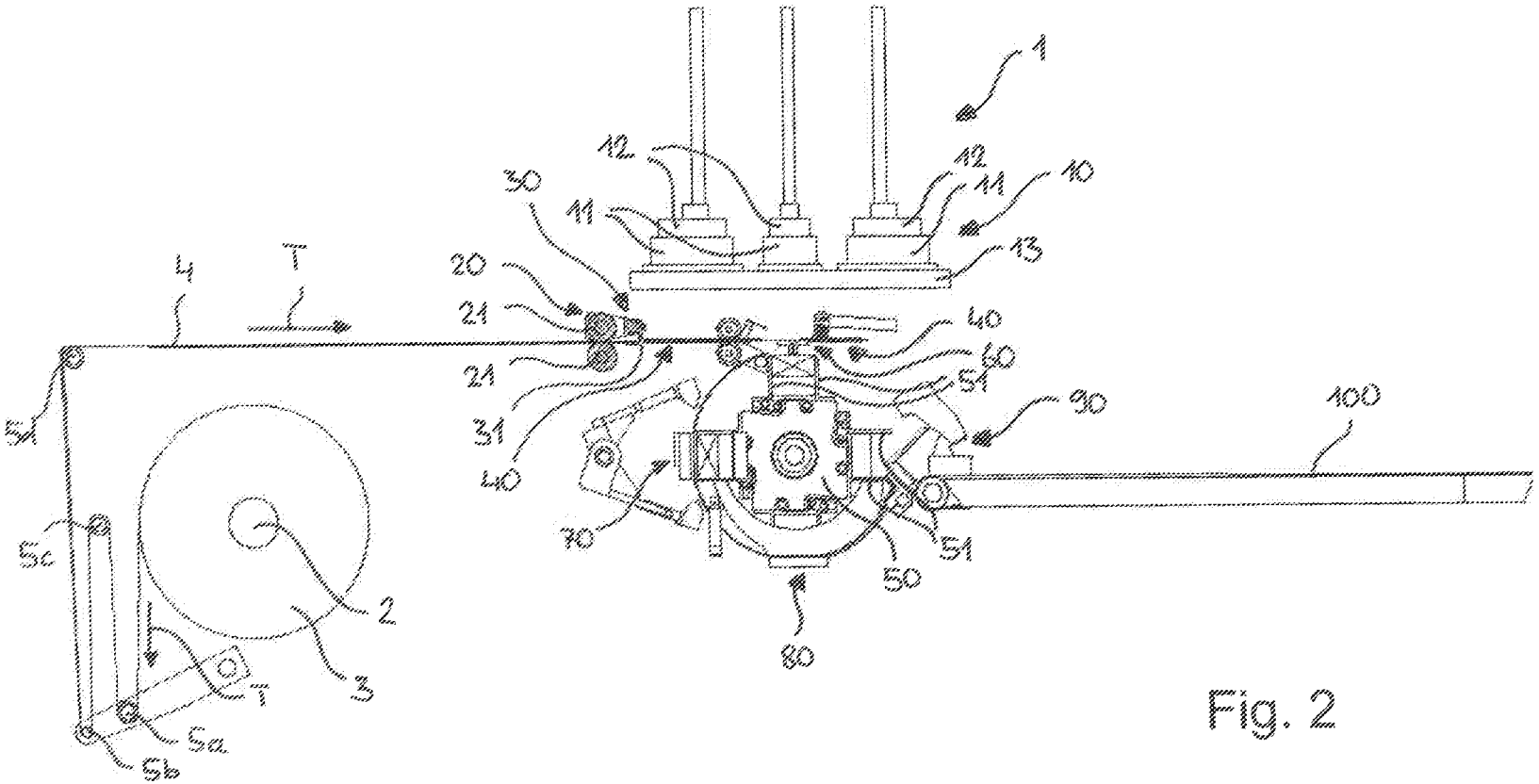
FIG. 2 shows a schematic lateral view of the packaging machine according to FIG. 1.

An exemplary embodiment of a packaging machine according to the invention, which in its entirety is provided with the reference sign 1, for packaging portioned products which are liquid or pasty in the processing state in a wrapper that is cut to length from a packaging material web is schematically reproduced in FIGS. 1 and 2, whereby the packaged product in the present case can be butter, for example, the packaging machine 1 of course also being suitable for packaging any other products which in the processing state are able to be transformed to a liquid or pasty or viscous state, respectively.

As can be seen from FIGS. 1 and 2, the packaging machine 1 comprises a support axle 2 which serves for receiving a roll 3 of a packaging material web 4 which is unwound from said roll 3 and may be composed of conventional packaging material, for example a film/foil material or a film/foil-composite material. A packaging material buffer comprising a plurality of deflection rollers 5*a*, 5*b*, 5*c*, 5*d* can adjoin the support axle 2, wherein one or a plurality of these rollers, such as the rollers 5*a* and/or 5*c*, for example, are mounted so as to be movable approximately parallel to the packaging material web 4 that is guided about said rollers, so as to ensure the buffering function for the packaging material.

The packaging machine 1 furthermore comprises a metering installation which is configured for metering a product portion of the product which is pasty in the processing state, and in the exemplary embodiment shown here comprises a pre-shaping installation 10 which is integrated in said metering installation and serves for metering and simultaneously pre-shaping a respective product portion. The pre-shaping installation 10 integrated in the metering installation in the present case has a plurality of presently four product-forming ducts 11 which are in each case equipped with a product ejector ram 12 which is able to be relocated in the axial direction of a respective product-forming duct 11 and which by being relocated from a respective product-forming duct 11 serves for ejecting a product portion that has been metered and pre-shaped in a respective product-forming duct 11, on the one hand, and in the position thereof retracted into a respective product-forming duct 11 may be height-adjustable in particular in relation to the respective product-forming duct so as to be able to predefine the desired metering volume, on the other hand. The product-forming ducts 11 in the present exemplary embodiment are disposed, preferably at equidistant circumferential spacings, on a rotatably mounted plate 13 which is rotatingly driven in cycles so as to transfer in each case one of the product-forming ducts 11 to a product-ejecting position in which the product portion pre-shaped in the product-forming duct 11 is ejected from the product-forming duct 11, while at least one other product-forming duct 11 is situated in a position in which a further product portion can be placed into said product-forming duct 11, so as to meter and simultaneously pre-shape said product portion in the product-forming duct 11.

The packaging machine 1, in the transporting direction T downstream of the packaging material buffer, comprises a transport installation 20 which is configured for transporting the packaging material web 4 in the direction of the pre-shaping installation 10 and has, for example, one or a plurality of indexing rollers 21, wherein one pair of indexing rollers 21 are provided in the present case, at least one of said indexing rollers 21 being rotatably driven in a continuous or cycled manner, and said indexing rollers 21 being able to be pressed onto one another so as to drive the packaging material web 4 with the desired indexing action by guiding the packaging material web 4 through the pair of indexing rollers 21. As can furthermore be derived from FIG. 1, the transport installation 20 can furthermore have a guide plate 22 so as to direct the packaging material web 4 into the intermediate space between the counter-rotating indexing rollers 21.

A cutting installation 30 which is configured for cutting to length planar blanks of in each case one wrapper from the packaging material web 4 is disposed in the transporting direction T of the packaging material web 4 downstream of the transport installation 20 and upstream of the pre-shaping installation 10, said cutting installation 30 having, for example, a cutting blade 31 which extends so as to be approximately perpendicular to the transporting direction T of the packaging material web 4 and which is mounted so as to be pivotable in a reciprocating manner about a pivot axis which likewise extends so as to be perpendicular to the transporting direction T of the packaging material web 4, so as to pivot said cutting blade 31 by motorized pivoting between a cutting position, in which said cutting blade 31 severs the packaging material web 4, and a resting position, in which said cutting blade 31 is disposed above or below the packaging material web 4. In the present exemplary embodiment, the pivot axis of the cutting blade 31 of the cutting installation 30 is congruent with the rotation axis of the upper indexing rollers 21 of the transport installation 20, for example, such that both can be mounted on a common support, this resulting in a high degree of compactness.

The cutting installation 30, again in the transporting direction T of the packaging material web 4, is adjoined by a guiding installation 40 which hereunder is described in detail with reference to FIG. 3 et seq. and is configured for transferring a respective planar blank of the wrapper that by means of the cutting installation 30 has been cut to length from the packaging material web 4 to a position above a pair of folding claws 51, the for example substantially plate-shaped folding claws of said pair of folding claws 51 being upwardly open in the direction of the pre-shaping installation 10 so as to be able to fold the planar blank of the wrapper between the pair of folding claws 51. A base 52 which is expediently able to be relocated in the radial direction of a folding wheel 50, so as to be able to adapt the volumetric capacity formed between the folding claws of the pair of folding claws 51 to the desired volume of a respective pre-shaped product portion and to in particular be able to calibrate the latter (see further below for more details to this end) is situated at the radially inward end of a respective pair of folding claws 51. In the exemplary embodiment shown, a plurality of, presently four, pairs of folding claws 51 are disposed, preferably at equidistant circumferential spacings, on the external circumference of the folding wheel 50, wherein the, for example substantially plate-shaped, folding claws of a respective pair of folding claws 51 extend in the axial direction of the folding wheel 50. The folding wheel 50, which is rotatingly driven in cycles, in the transporting direction T of the packaging material web 4 here is mounted downstream of the cutting installation 30 and below a respective product-forming duct 11 of the product pre-shaping installation 10 that by rotating the plate 13 is transferred to the ejecting position of said product-forming duct 11 so as to be rotatable about an axis which extends so as to be approximately perpendicular to the transporting direction T of the packaging material web 4, wherein the folding wheel 50 in the present case, in the views of FIGS. 1 and 2 as well as of FIGS. 3 to 19, is rotatingly driven in a cycled and counter-clockwise manner.

A first folding and connecting station 60, on the one hand, and a second folding and connecting station 70, on the other hand, are further disposed on different circumferential regions of the folding wheel 50, wherein the circumferential spacing of the first folding and connecting station 60 from the second folding and connecting station 70 corresponds to the circumferential spacing between two neighbouring pairs of folding claws 51 of the folding wheel 50, in the present case thus 90° and a total of four pairs of folding claws 51. While the first folding and connecting station 60 serves for folding the lateral longitudinal peripheries of a respective upwardly open wrapper that is folded into a respective pair of folding claws 51 and is provided with a pre-shaped product portion inward onto the pre-shaped product portion, and simultaneously for connecting these lateral longitudinal peripheries to one another, the second folding and connecting station 70, which in the direction of rotation of the folding wheel 50 is disposed downstream of the first folding and connecting station 60, serves for folding the transverse peripheries of the wrapper which extend so as to be substantially perpendicular to the lateral longitudinal peripheries of said wrapper inward onto the pre-shaped product portion, and simultaneously for connecting these transverse peripheries to one another, as is explained in detail further below with reference to FIG. 3 et seq. The first folding and connecting station 60 in the exemplary embodiment reproduced in the drawing is disposed on the same circumferential region of the folding wheel 50 as the pre-shaping installation 10, or more specifically like a respective product-forming duct 11 of the pre-shaping installation that is transferred to its ejecting position by rotating the plate 13, so that one pre-shaped product portion is in each case placed on a respective pair of folding claws 51 of the folding wheel 50, and a respective blank by means of the product ejector ram 12 of the product-forming duct 11 can simultaneously be folded into the pair of folding claws 51 while the pre-shaped product portion is ejected from the product-forming duct 11, whereupon the lateral longitudinal peripheries of the inward-folded wrapper by means of the first folding and connecting station 60 are promptly folded inward onto the pre-shaped product portion and connected to one another without having to rotate the folding wheel 50 any further.

As is furthermore derived from FIGS. 1 and 2, the packaging machine 1 furthermore comprises a calibrating station 80 which is disposed in the circumferential region of the folding wheel 50 and in the direction of rotation of the latter is disposed downstream of the second folding and connecting station 70 (see further below for more details to this end), said calibrating station 80 serving for calibrating a respective completely packaged product portion under pressure, the circumferential spacing of said calibrating station 80 from the second folding and connecting station 70 in turn corresponding to the circumferential spacing of two neighbouring pairs of folding claws 51 of the folding wheel 50, in the present case thus again 90°.

The packaging machine finally comprises a delivery station 90 which is disposed in the circumferential region of the folding wheel 50 and in the direction of rotation of the latter is disposed downstream of the calibrating station 80 (also see below for further details to this end), said delivery station 90 serving for delivering a respective completely packaged and calibrated product portion from a respective pair of folding claws 51 of the folding wheel 50, the circumferential spacing of said delivery station 90 from the calibrating station as well as from the pre-shaping installation 10 and from the first folding and connecting station 60 again corresponding to the circumferential spacing of two neighbouring pairs of folding claws 51 of the folding wheel 50, in the present case thus again 90°. In the present case, a conveyor belt 100 for transporting away the wrapper packaging that is delivered from the pair of folding claws 51 of the folding wheel 50 and supplying said wrapper packaging to a store (not shown) is disposed downstream of the delivery station 90, for example.

Figure 3:
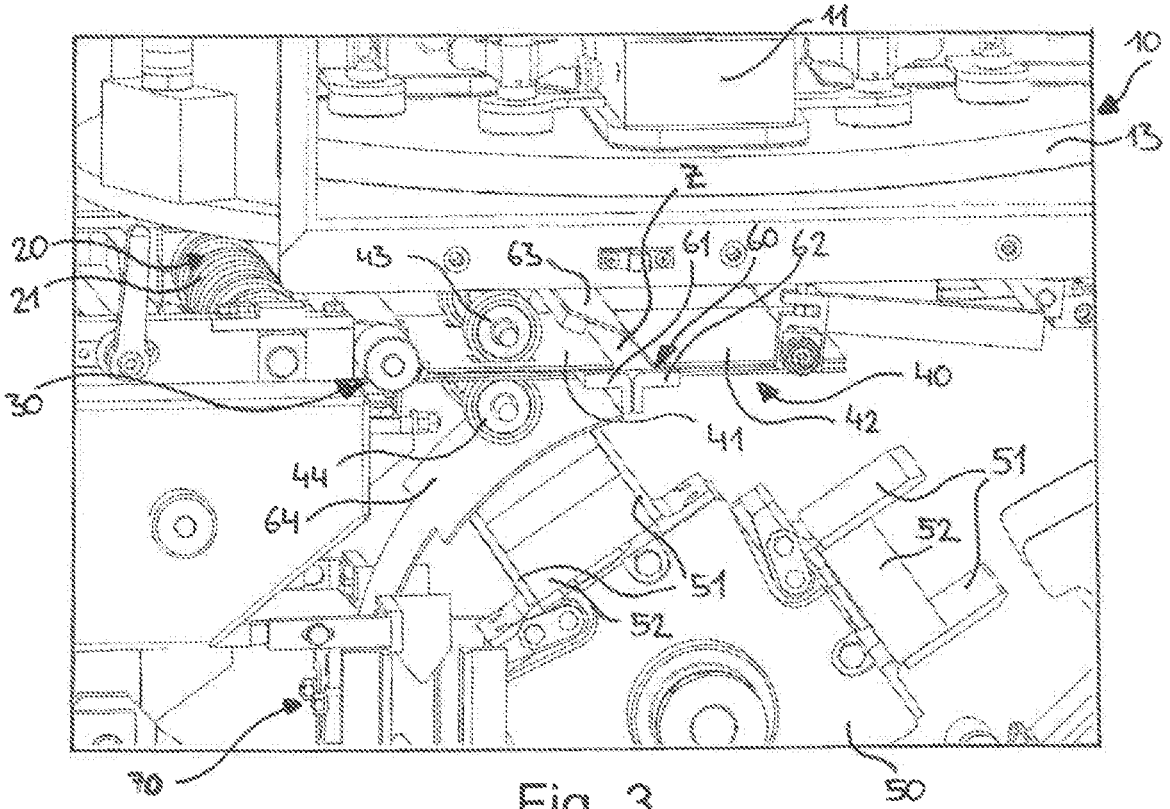
FIGS. 3 to 20 show in each case a schematic detailed view of the packaging machine according to FIGS. 1 and 2 in various operating stages during the packaging of the product into the wrapper, so as to visualize the packaging method carried out herewith.

As can be seen in particular from FIGS. 3 to 10, the guiding installation 40, which is disposed directly downstream of the cutting installation 30 that is situated at the downstream end of the transport installation 20 (the cutting blade 31 of said cutting installation 30 not again being provided with reference signs in FIG. 3 et seq. for reasons of clarity) is disposed between a respective product-forming duct 11 of the product pre-shaping installation 10, said product-forming duct 11 being transferred to the ejecting position thereof by means of the plate 13 which is rotatable in a cycled manner, and a respective pair of folding claws 51 of the folding wheel 50 that has been transferred to the product-forming duct 11 by rotating the folding wheel 50 in a cycled manner, so as to, when a respective product portion that has been pre-shaped in a respective product-forming duct 11 by means of the respective product ejector ram 12 is ejected from the product-forming duct 11 into the respective pair of folding claws 51, be able to simultaneously fold the blank of the wrapper that by means of the guiding installation 40 has been introduced into the intermediate space between the respective product-forming duct 11 and the respective pair of folding claws 51 inward into the respective pair of folding claws 51. The guiding installation 40 in the present case here has a first pair 41 of first guiding means which are disposed so as to be mutually parallel, as well as a second pair 42 of second guiding means which are disposed so as to be mutually parallel, wherein the first and second guiding means in the exemplary embodiment shown are in each case formed by parallel plates in the manner of baffles, a respective blank of a wrapper that by means of the cutting installation 30 has been cut to length from the packaging material web 4 being able to be guided into the intermediate space between said plates. Two pairs 43, 44 of guide rollers which in the present case are expediently mounted so as to be pivotable serve for driving a respective blank that is guided between the pairs 41, 42 of the first and second guiding means, wherein the first pair 43 of guide rollers engage through cut-outs of the upper guiding means of the first pair 41 of the guiding means, and the second pair 44 of guide rollers engage through cut-outs of the lower guiding means of the first pair 41 of the guiding means such that a blank of a wrapper that is situated between the first pair 41 of the guiding means can be guided between a respective product-forming duct 11 of the pre-shaping installation 10 and a respective pair of folding claws 51 of the folding wheel 50 by virtue of the pairs 43, 44 of guide rollers being driven in a counter-rotating manner.

The first pair 41 of the first guiding means here directly adjoins the cutting installation 30 which in the transporting direction T of the packaging material web 4 is disposed downstream of the transport installation 20, so as to therebetween receive a respective blank of a respective wrapper that by means of the cutting installation 30 has been cut to length from the packaging material web 4, and to transport said blank onward by means of the pairs 43, 44 of guide rollers. The second pair 42 of the second guiding means, again when viewed in the transporting direction of the blank, adjoins the first pair 41 of the first guiding means that terminates in a position directly above a respective pair of folding claws 51 of the folding wheel 50, so as to guide onward the blank of a respective wrapper from the intermediate space between the first pair 41 of the first guiding means to the second pair 42 of the second guiding means. While the first pair 41 of the first guiding means can be disposed so as to be stationary, for example, the second pair 42 of the second guiding means is able to be moved in a reciprocating manner between a first position, in which the second pair 42 of the second guiding means adjoins the first pair 41 of the first guiding means and in this way bridges the pair of folding claws 51 (cf. FIG. 3, for example), and a second position in which the second pair 42 of the second guiding means is disposed at a spacing from the first pair 41 of the first guiding means that leaves vacant the open cross section of the pair of folding claws 51 (cf. FIG. 4, for example). In the first position of the second pair 42 of the second guiding means relative to the first pair 41 of the first guiding means, in which first position the first pair 41 and second pair 42 of the guiding means adjoin one another, the blank by means of the two pairs 43, 44 of guide rollers can consequently be moved through the intermediate space of the guiding means of both pairs 41, 42 up to a position above a respective pair of folding claws 51, while in the second position of the second pair 42 of the guiding means, having a spacing from the first pair 41 of the guiding means, the blank at the periphery thereof that is leading in the transporting direction T, as well as at the rear periphery thereof that is trailing in the transporting direction T, can be positioned directly above a respective pair of folding claws 51 so as to fold the blank inward into the pair of folding claws 51 when the pre-shaped product portion by means of a respective product ejector ram 12 of a respective product-forming duct 11 of the pre-shaping installation 10 is ejected into a respective pair of folding claws 51.

Figure 4:
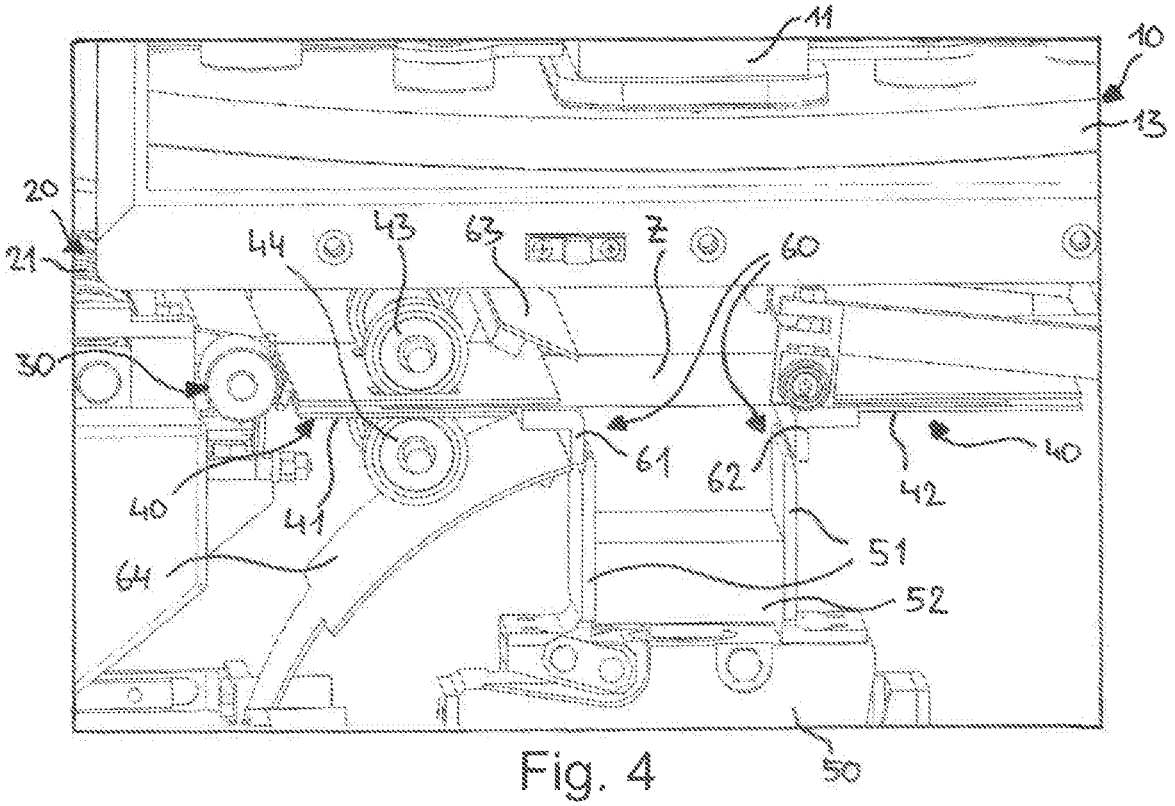

As is furthermore derived in particular from FIGS. 3 to 10, the first folding and connecting station 60 comprises two first folding and connecting tools 61, 62 which under a contact pressure are able to be converged and diverged, here parallel to the transporting direction T of the blank, said first folding and connecting tools 61, 62 in the illustration according to FIG. 4 having been moved to a first folding and connecting position relative to one of the pairs of folding claws 51 of the folding wheel 50, for example, in which the first folding and connecting tools 61, 62 of the first folding and connecting station 60 are situated directly above the pair of folding claws 51 so as to, by relocating the first folding and connecting tools 61, 62 towards one another (cf. FIGS. 7 to 10) in a manner substantially parallel to the open upper side of the pair of folding claws 51, while pressing together the lateral longitudinal peripheries of the upwardly open wrapper that is situated in the pair of folding claws 51 and provided with a pre-shaped product portion, be able to fold said lateral longitudinal peripheries inward onto the pre-shaped product portion and simultaneously connect said lateral longitudinal peripheries to one another. In the exemplary embodiment shown here, the one first folding and connecting tool 61 is disposed on the (presently stationary) first pair 41 of the first guiding means of the guiding installation 40 so as to be able to be relocated in the transporting direction T of the blank, while the other first folding and connecting tool 62 is disposed so as to be stationary on the second pair 42 of the second guiding means of the guiding installation 40, said second pair 42 being able to be moved in a reciprocating manner parallel to the transporting direction T, so as to be able to move said other first folding and connecting tool 62, conjointly with the second pair 42 of the second guiding means of the guiding installation 40, towards the first folding and connecting tool 61 and away from the latter.

The first folding and connecting tools 61, 62 here can be configured in the form of cold-sealing tools, for example, so as to cold-seal to one another the cold adhesive coatings already applied locally to the wrapper, or to the packaging material web 4, respectively (see further below for details to this end with reference to FIG. 20). The first folding and connecting station 60 moreover preferably has a packaging material barrier 63 which is pivotable into the intermediate space between the first folding and connecting tools 61, 62 and out of the latter (as long as said first folding and connecting tools 61, 62 are situated in the mutually spaced apart position thereof; cf. in particular FIGS. 6 to 8), said packaging material barrier 63 for this purpose being mounted on a pivot axis which is perpendicular to the transporting direction T and serves to prevent any premature contact between the lateral longitudinal peripheries of the wrapper, which have in particular already been provided with a cold adhesive, before said lateral longitudinal peripheries are connected to one another by means of the first folding and connecting tools 61, 62 of the first folding and connecting station.

In a furthermore advantageous design embodiment, the first folding and connecting station 60 can moreover have a first turn-over unit 64 which serves for turning over the lateral longitudinal peripheries of the wrapper that initially project upward in a substantially perpendicular manner from the pre-shaped product portion and are connected to one another by means of the first folding and connecting tools 61, 62. The first turn-over unit 64 in the exemplary embodiment shown comprises a baffle which extends substantially in the circumferential direction of the folding wheel 50 and, when viewed in the circumferential direction of the latter, is disposed between the first folding and connecting station 60 and the second folding and connecting station 70, the lateral longitudinal peripheries of the wrapper that are connected to one another contacting that end of said baffle that faces the first folding and connecting station 60 such that said lateral longitudinal peripheries are turned over against the upper, radially outward side of the wrapper when the folding wheel 50 is rotated when a wrapper that is provided with the pre-shaped product portion is transferred from the first folding and connecting station 60 to the second folding and connecting station 70.

As can be derived in particular from FIGS. 11 to 14, the second folding and connecting station 70 comprises in each case two second folding and connecting tools 71*a*, 71*b*, 72*a*, 72*b* which are disposed on the opposite open transverse sides of a respective pair of folding claws 51 and under a contact pressure are able to be converged and diverged, wherein a respective pair of folding claws 51 of the folding wheel 50 by rotating the latter can be moved to a second folding and connecting position relative to the second folding and connecting tools 71*a*, 71*b*, 72*a*, 72*b* in which the pair of folding claws 51 which is open in the direction of the two transverse sides of the pre-shaped product portion that is situated in the pair of folding claws 51 is situated in the interior of the second folding and connecting station 70, that is to say having a respective open transverse side between in each case one first folding and connecting tool 71*a*, 71*b* and in each case one second folding and connecting tool 72*a*, 72*b*, so as to fold the lateral transverse peripheries of the wrapper that is situated in the pair of folding claws 51 and provided with a pre-shaped product portion in each case inward onto the pre-shaped product portion and simultaneously connect said lateral transverse peripheries to one another. In a manner similar to that of the first folding and connecting tools 61, 62, the second folding and connecting tools 71*a*, 71*b*, 72*a*, 72*b*, can also be configured in the form of cold-sealing tools, for example, so as to cold-seal the cold adhesive coatings already applied locally to the wrapper or to the packaging material web 4, respectively, to one another (see further below for details to this end with reference to FIG. 21). Moreover, the second folding and connecting station 70 has in each case two third folding tools 73*a*, 73*b*, 74*a*, 74*b* in the manner of so-called "penetrating folding units" which are in each case able to be converged and diverged in a direction of movement which is parallel to the respective plane of movement of the second folding and connecting tools 71*a*, 71*b*, 72*a*, 72*b* but substantially perpendicular to the direction of movement of the latter, so as to, when the transverse peripheries of the wrapper are folded onto the pre-shaped product portion and these transverse peripheries are connected to one another by means of the second folding and connecting tools 71*a*, 71*b*, 72*a*, 72*b*, to first fold the two opposite peripheral portions of the wrapper that are situated between the transverse peripheries of the latter, in each case inward in a substantially triangular shape onto the product portion, and thereafter by means of the second folding and connecting tools 71*a*, 71*b*, 72*a*, 72*b* fold the transverse peripheries of the wrapper in each case outward onto the peripheral portions of the wrapper that have been folded inward in a substantially triangular shape, and simultaneously connect said transverse peripheries to one another.

In one advantageous design embodiment, the second folding and connecting station 70 can moreover have second turn-over units 75 which serve for turning over the transverse peripheries of the wrapper that initially project in a substantially perpendicular manner from the pre-shaped product portion to both transverse sides and are connected to one another by means of the second folding and connecting tools 71*a*, 71*b*, 72*a*, 72*b*. In a manner similar to that of the first turn-over unit 64, a respective second turn-over unit 75 in the exemplary embodiment shown comprises in each case one baffle which extends substantially in the circumferential direction of the folding wheel 50 and, when viewed in the circumferential direction of the latter, is disposed between the second folding and connecting station 70 and the calibrating station 80, the transverse peripheries of the wrapper that are connected to one another in each case contacting that end of said baffle that faces the second folding and connecting station 70 such that said transverse peripheries are turned over against the respective transverse side of the wrapper when the folding wheel 50 is rotated when a wrapper that is provided with the pre-shaped product portion is transferred from the second folding and connecting station 70 to the calibrating station 80.

Figure 14:
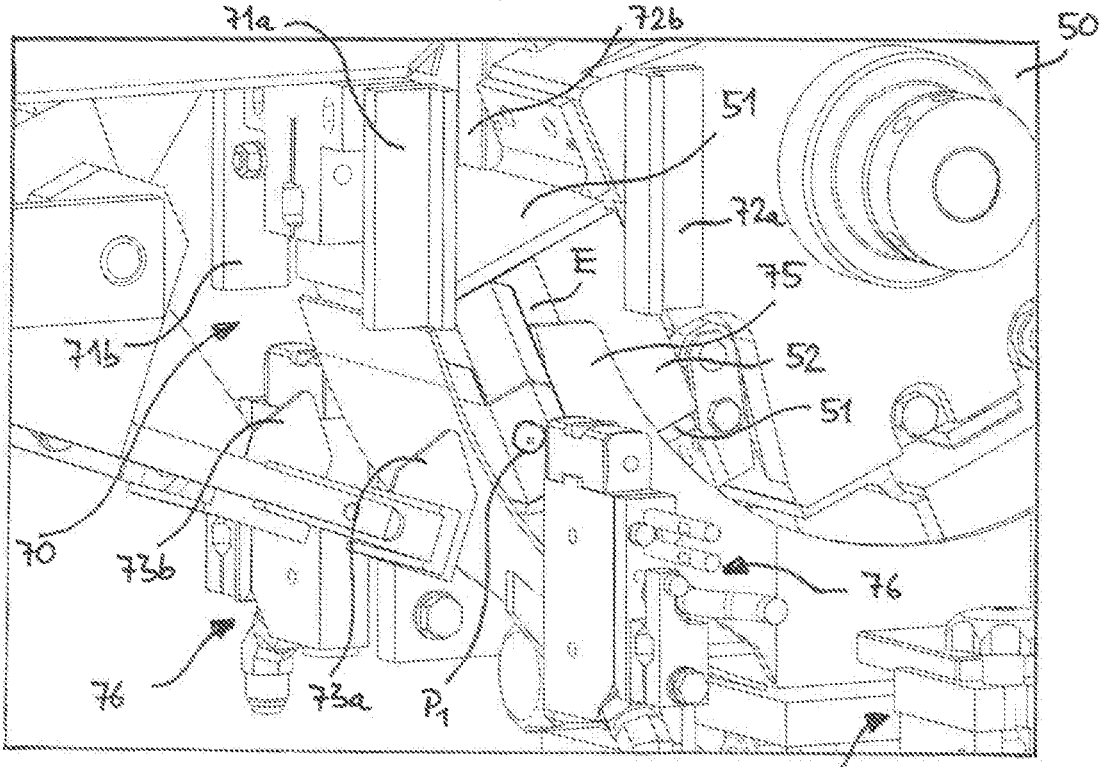
Figure 15:
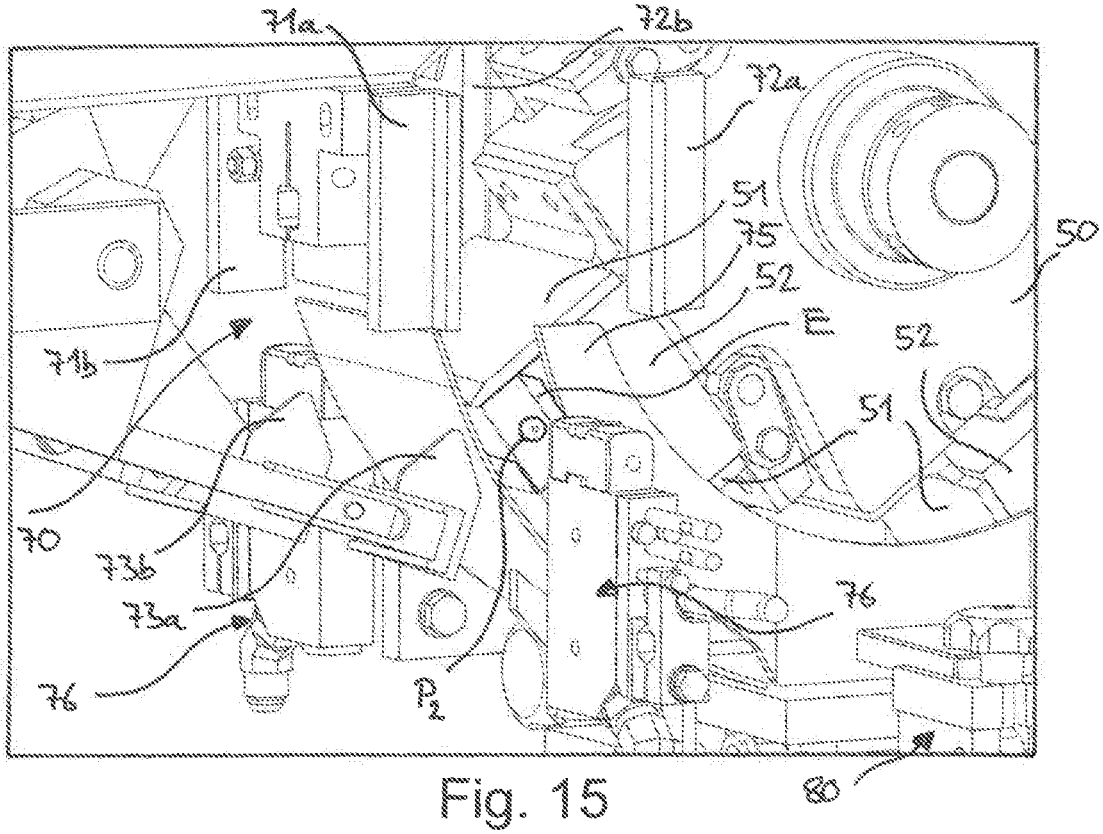
Figure 16:
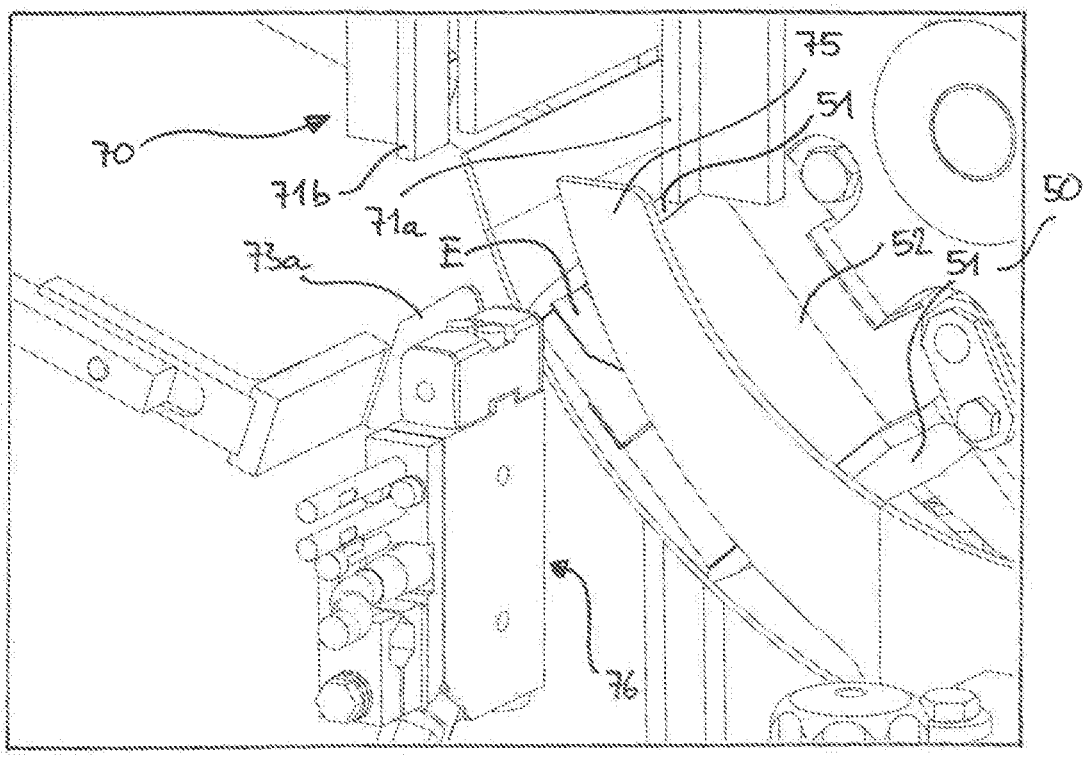

As is derived in particular from FIGS. 14 to 16, it can furthermore be provided in an advantageous design embodiment that the second folding and connecting station 70 is assigned a cold adhesive application station 76 which, when viewed in the circumferential direction of the folding wheel 50, is in particular disposed between the second folding and connecting station 70 and the calibrating station 80 and upstream of the second turnover units 75. The cold adhesive application station 76 in the present case is disposed on both sides of the folding wheel 50 and serves for applying, here in an exemplary manner in each case two, cold adhesive spots $P_1$ (FIG. 14) and $P_2$ (FIG. 15) to the transverse sides of the wrapper close to the transverse peripheries that are connected to one another by means of the second folding and connecting tools 71*a*, 71*b*, 72*a*, 72*b* such that the transverse peripheries of the wrapper that are connected to one another are adhesively bonded to the transverse sides of said wrapper as soon as the wrapper that is situated in a respective pair of folding claws 51 of the folding wheel has passed the second turn-over units 75.

Figure 17:
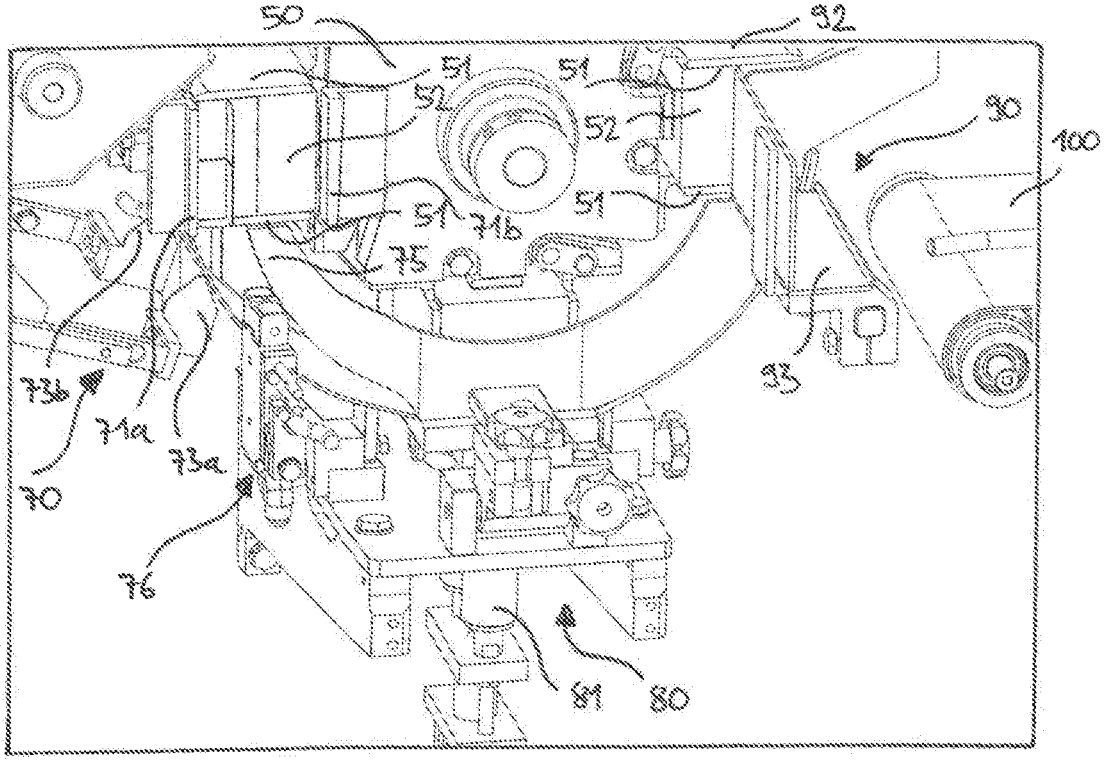

As can be seen primarily in FIG. 17, the calibrating station 80 can be configured substantially according to the prior art and comprise, for example, a piston/cylinder unit 81 which is effective in the radial direction of the folding wheel 50, a compression plate which cannot be seen in the drawing and is able to be pressed against the open upper side of a respective pair of folding claws 51 that by rotating the folding wheel 50 is transferred to the calibrating station 80 so as to calibrate the product portion that is situated in said pair of folding claws 51 and are enclosed on all sides by the wrapper, being established on the sides of said piston/cylinder unit 81 that face the folding wheel 50, whereby the cold adhesive spots that have previously been applied by means of the cold adhesive application station 76 are preferably also cured and adhesively bonded in a durable manner.

Figure 18:
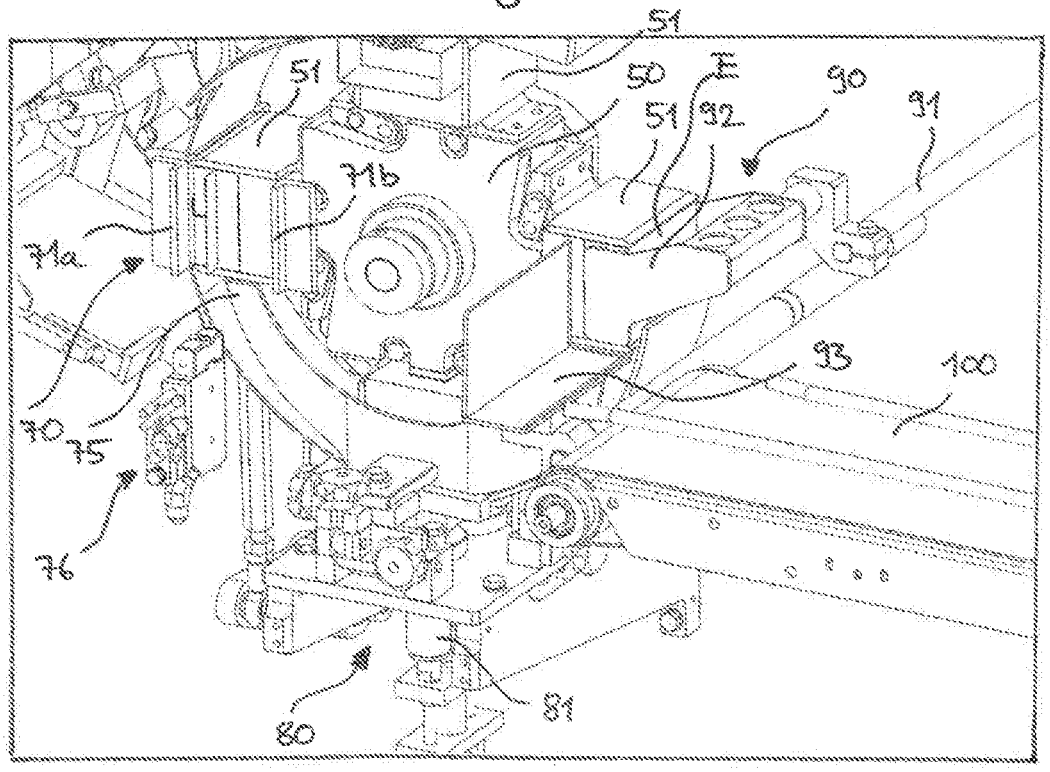
Figure 19:
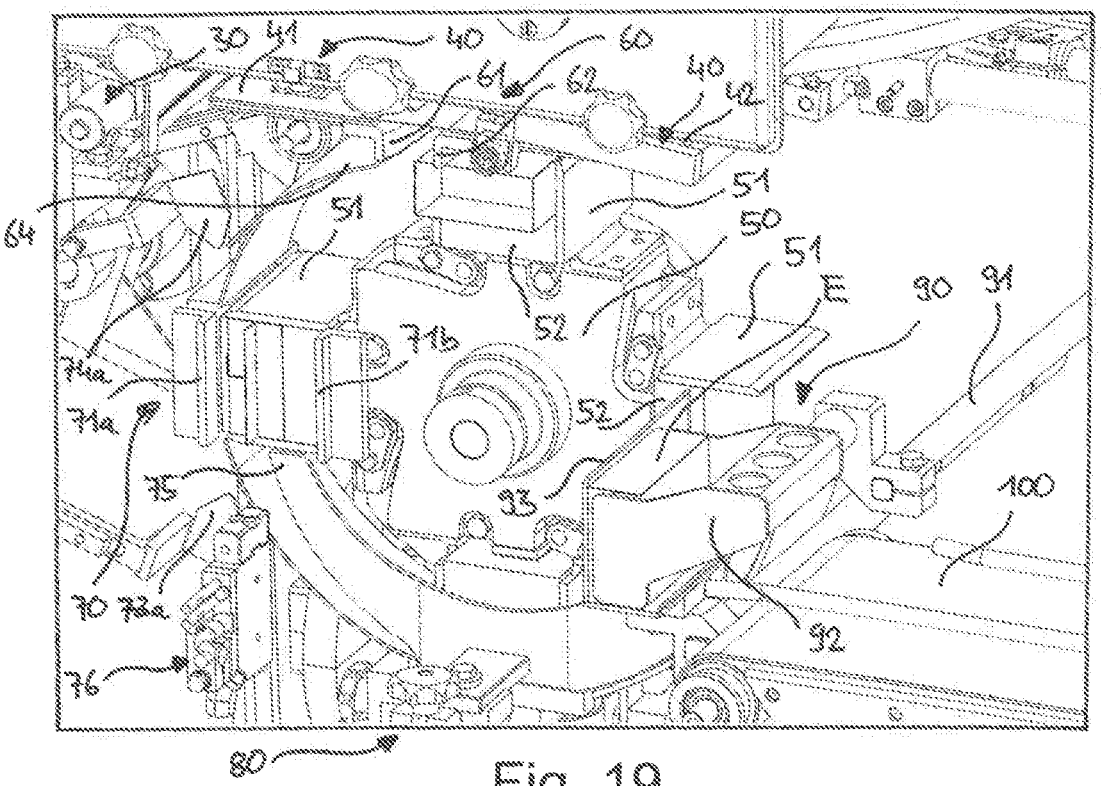
Figure 20:
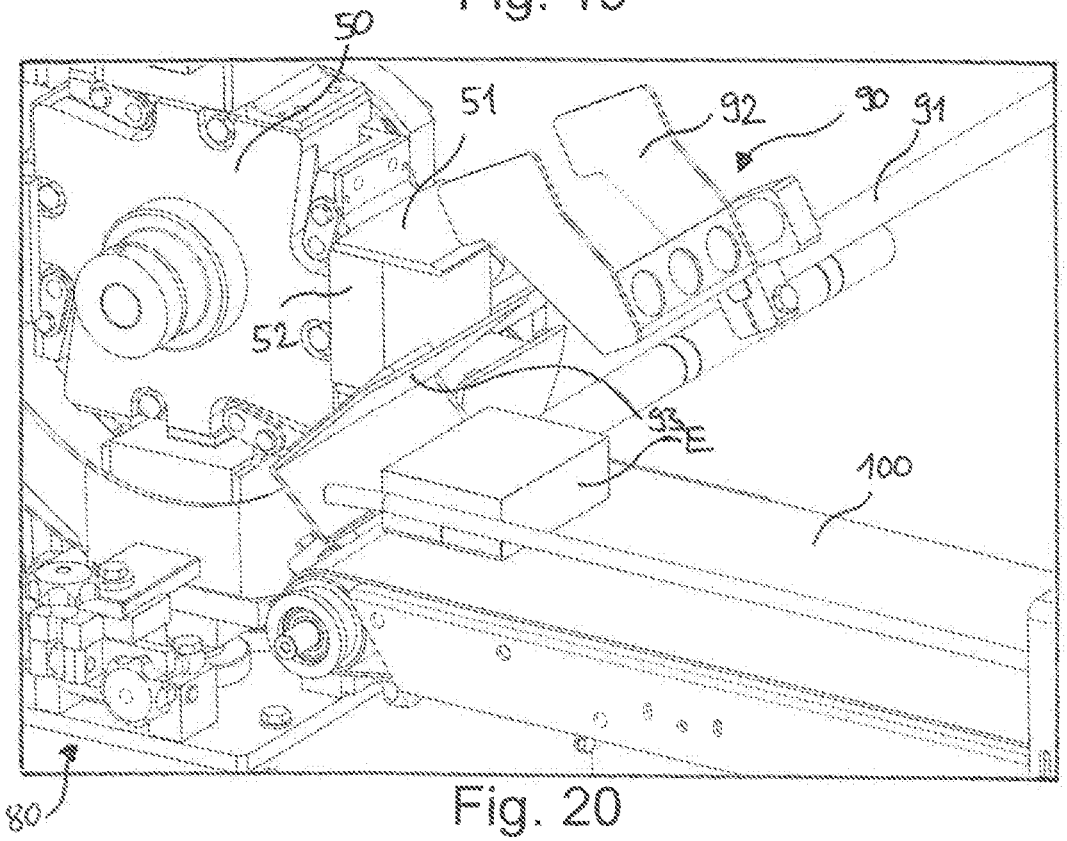

FIGS. 18 to 20 finally show the delivery station 90 having the conveyor belt 100 which is disposed downstream of said delivery station 90, the delivery station 90 and the conveyor belt 100 potentially being likewise designed substantially according to the prior art. The delivery station 90 in the present exemplary embodiment thus comprises for example a slide 92 which is able to be relocated in a reciprocating manner along a guide rod 91 that extends parallel to the axial direction of the folding wheel 50 and by means of which a respective calibrated product portion that is completely packaged by the wrapper and by rotating the folding wheel 50 has been transferred to the delivery station 90 can be transferred from a respective pair of folding claws 51 to a parcel reverser 93 which is able to be tilted parallel to the axial direction of the folding wheel 50 and which by tilting the completely packaged product portion is able to transfer the latter onto the conveyor belt 100.

The functional mode of the packaging machine 1 is explained in more detail hereunder by means of a method for packaging portioned products which are liquid or pasty in the processing state, presently butter, in a wrapper that has been cut to length from the packaging material web 4.

As can be derived from FIGS. 1 and 2, the packaging material roll 3 is unwound in the transporting direction T from the support axle 2 in that the indexing rollers 21 of the transport installation 20 are set in rotation at the desired indexing speed. As can be seen in particular from FIG. 3, a planar blank Z of the wrapper by means of the cutting blade 31 of the cutting installation 30 is in each case cut to length from the packaging material web 4 and by means of the guiding installation 40 positioned above a respective pair of folding claws 51 of the folding wheel 50. This takes place in such a manner that, immediately upon cutting to length the packaging material web 4 so as to form the blank Z, the two pairs 41, 42 of the first and second guiding means of the guiding installation 40 have been moved to the position which is shown in FIG. 3 and in which the second pair 42 of the second guiding means that are able to be relocated in the transporting direction T directly adjoins the stationary first pair 41 of the first guiding means, whereupon the blank Z is positioned above a pair of folding claws 51 by rotating the two pairs 43, 44 of guide rollers in a counter-rotating manner, said pair of folding claws 51 having been positioned directly below a product-forming duct 11 of the pre-shaping installation 10 by rotating the folding wheel 50, said product-forming duct 11 in turn having been positioned above this pair of folding claws 51 as well as above the blank Z by rotating the plate 13. The product-forming duct 11 of the pre-shaping installation 10 integrated in the metering installation by means of a product infeed (not shown) has previously been populated with the pasty product to be packaged so as to meter or portion, respectively, and pre-shape the latter in the product-forming duct 11.

As can be derived from FIG. 4, the second pair 42 of the second guiding means is thereupon relocated away from the first pair 41 of the first guiding means such that the upwardly open cross section of the pair of folding claws 51 is situated between the first pair 41 and the second pair 42 of the guiding means, and the blank Z is held at the periphery in each case by one of the mutually facing ends of a respective pair 41, 42 of the guiding means. The packaging material barrier 63 of the first folding and connecting station 60 in this stage is still situated in a position that is pivoted away from the open cross section of the pair of folding claws 51 and is above the two pairs 41, 42 of the guiding means of the guiding installation 40; the first folding and connecting tools 61, 62 of the first folding and connecting station 60 are in each case situated on opposite sides above the open cross section of the pair of folding claws 51 and likewise expose said open cross section.

Figure 5:
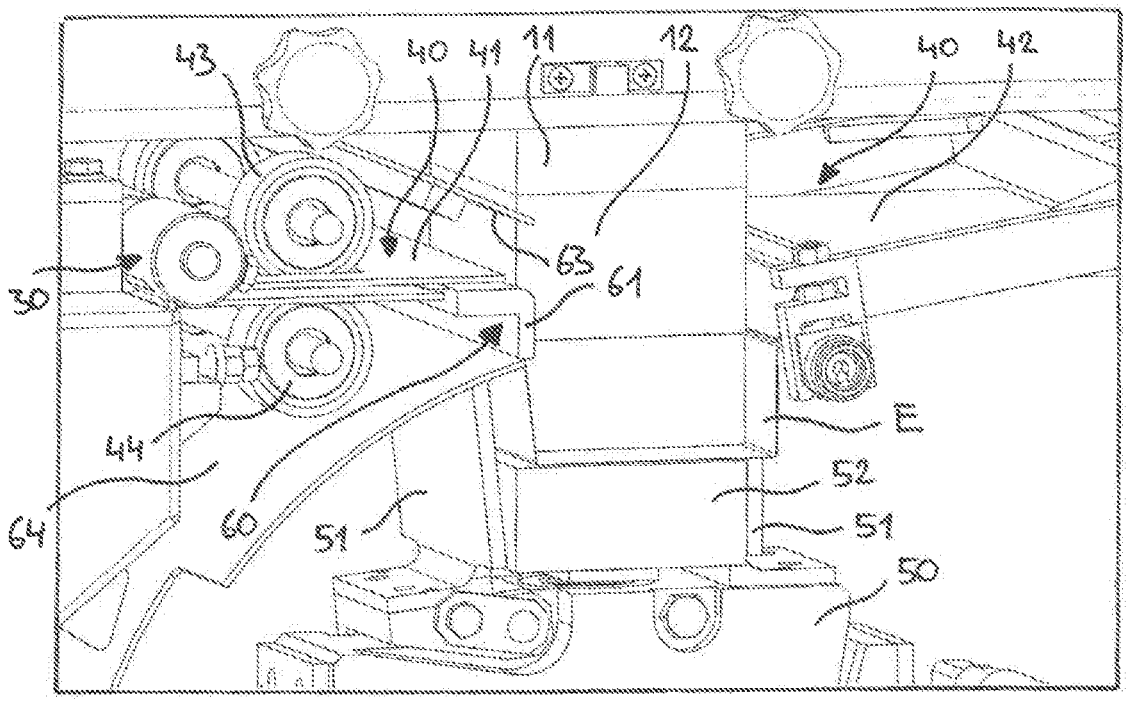
Figure 6:
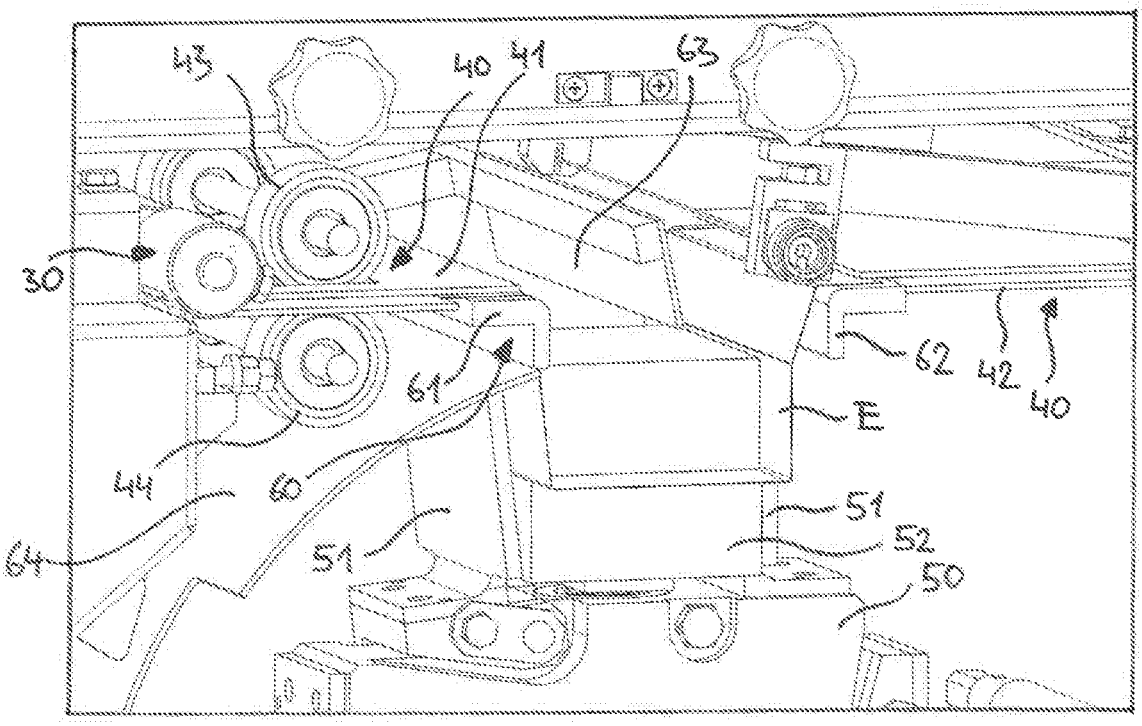

As is derived from FIG. 5, the product portion that has been pre-shaped in the product-forming duct 11 of the pre-shaping installation 10 is now placed on the pair of folding claws 51 by relocating the product ejector ram 12 which is guided in a height-adjustable manner in the product-forming duct 11 (cf. FIGS. 1 and 2), on account of which the blank Z positioned between the product-forming duct 11 and the pair of folding claws 51 (cf. FIG. 4) is folded inward into the pair of folding claws 51 while forming an upwardly open wrapper E which consequently is now disposed so as to be substantially U-shaped and bears on the base 52, on the one hand, and on the internal side of a respective folding claw of the pair of folding claws 51, on the other hand.

Once the product ejector ram 12 in the situation reproduced in FIG. 6 has again been relocated into the product-forming duct 11, the packaging material barrier 63 is pivoted inward so as to be between the first folding and connecting tools 61, 62 of the first folding and connecting station 60 still situated on either side of the pair of folding claws 51, so as to prevent that these longitudinal peripheries prematurely contact and adhere to one another at the previously locally applied cold adhesive coating when the lateral longitudinal peripheries of the wrapper E are subsequently connected (in the present case by cold sealing).

Figure 7:
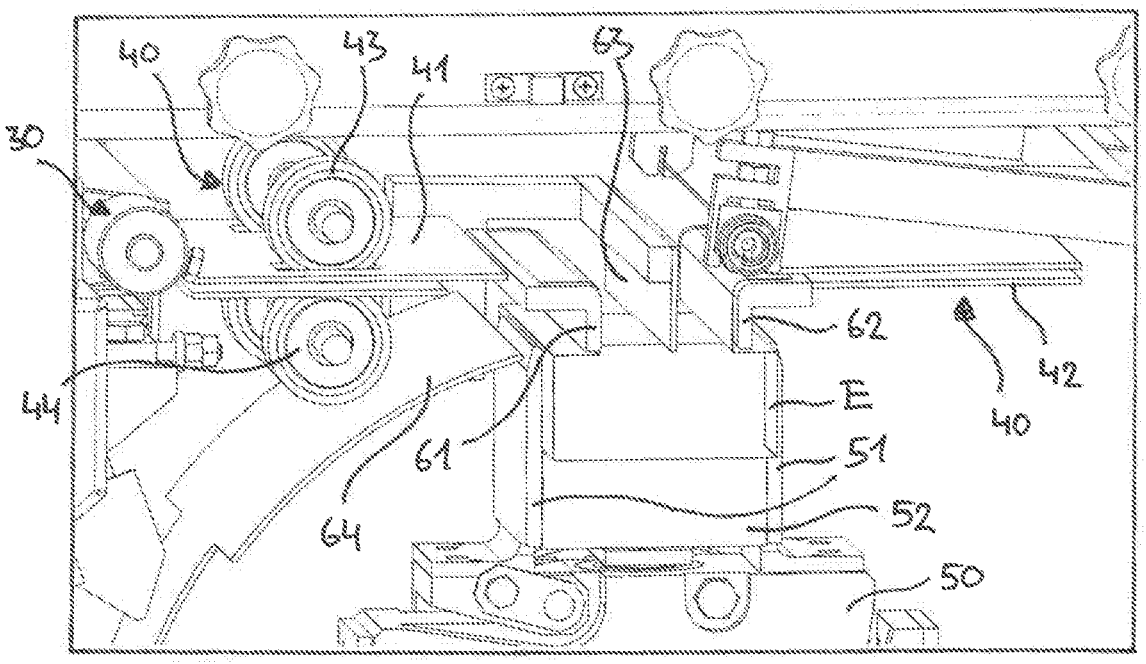
Figure 8:
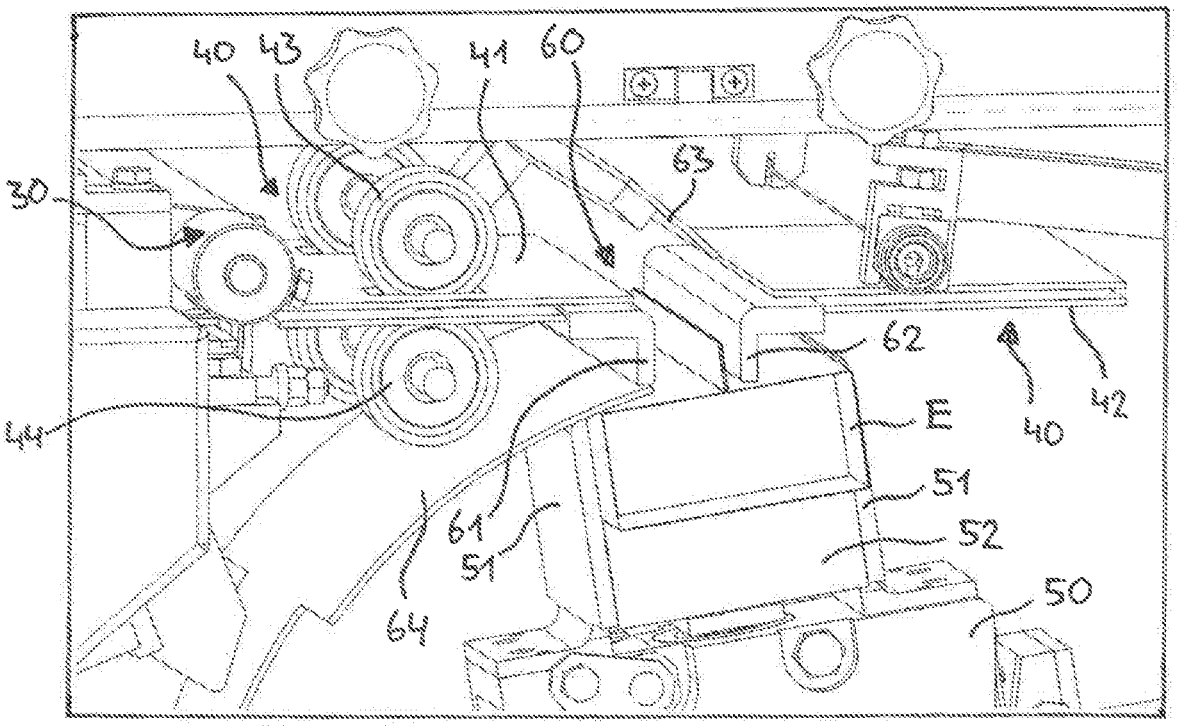
Figure 9:
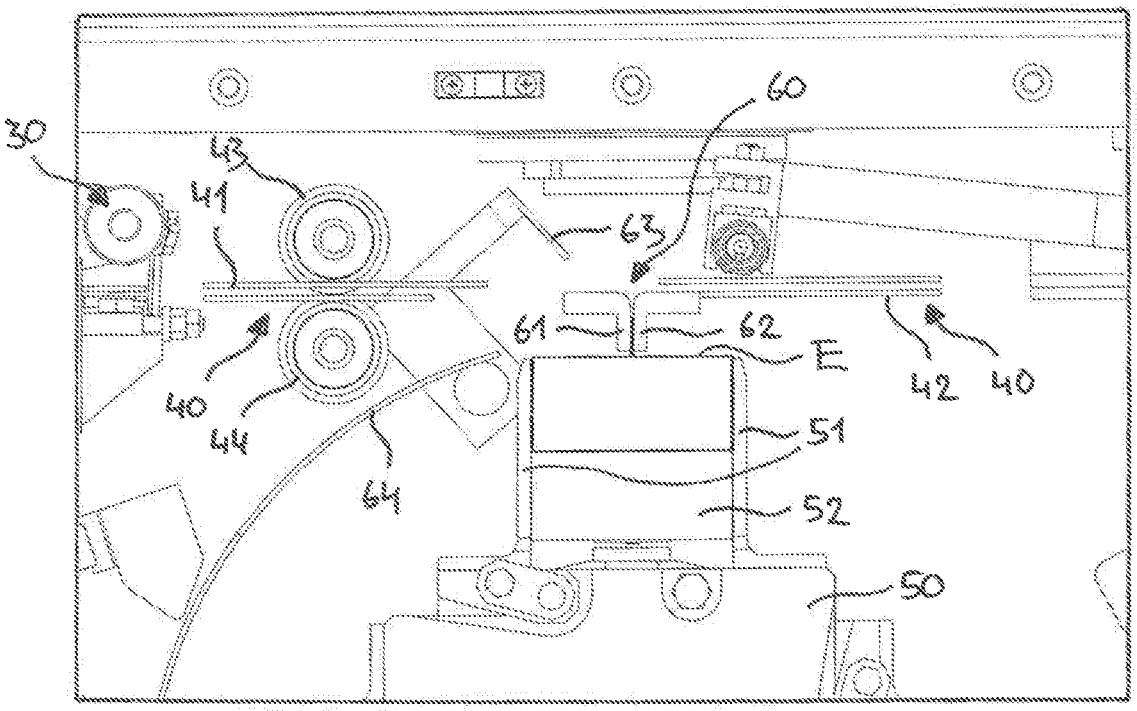

As is shown in FIG. 7, the first folding and connecting tools 61, 62 are thereafter converged so as to fold the lateral longitudinal peripheries of the wrapper E inward onto the upper side of the pre-shaped product portion that has been introduced into the pair of folding claws 51. In the present exemplary embodiment this takes place in that the first folding and connecting tool 62 which is to the right in FIG. 7 and is established so as to be stationary on the second pair 42 of the second guiding means of the guiding installation 40, is moved conjointly with the second pair 42 of the second guiding means towards the left (the second pair 42 of the second guiding means in this way is thus again relocated in the direction of the position shown in FIG. 3, so as to be able to guide a further blank Z to above a further pair of folding claws 51), while the first folding and connecting tool 61 on the left by the stationary first pair 41 of the first guiding means is moved away towards the right. Shortly before the two first folding and connecting tools 61, 62 of the first folding and connecting station 60 contact one another, the packaging material barrier 63 is pivoted upward away from the intermediate space between the two first folding and connecting tools 61, 62, and the first folding and connecting tools 61, 62 are further converged until said first folding and connecting tools 61, 62 in the situation shown in FIG. 9, under a mutual contact pressure, connect the two lateral longitudinal peripheries of the wrapper E to one another (not shown), said wrapper E now surrounding the pre-shaped product portion in a substantially tubular manner.

Figure 10:
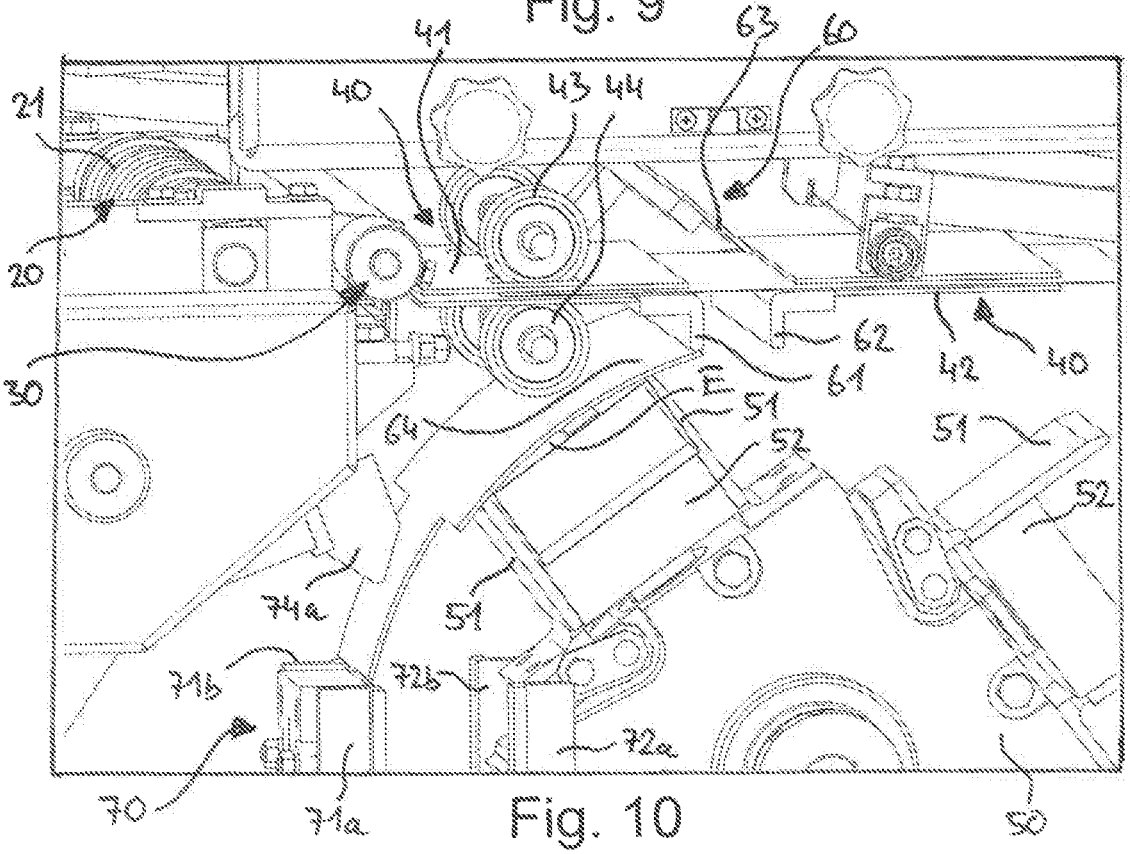

As soon as this has taken place, the folding and connecting tool 61 on the left, in the situation according to FIG. 10, is again relocated towards the left, in the direction of the first pair 41 of the first guiding means of the guiding installation 40, whereupon the folding wheel 50 is rotated by 90° in a counter-clockwise manner so as to transfer the pre-shaped product portion, which is now enclosed in an approximately tubular manner by the wrapper E, to the second folding and connecting station 70. The lateral longitudinal peripheries of the wrapper E which are connected to one another and which, immediately upon having been connected to one another by means of the first folding and connecting tools 61, 62, still project in a substantially perpendicular manner from the upper side of the pre-shaped product portion, when passing the first turn-over unit 64 are turned over in an approximately parallel manner onto the upper side of the wrapper E, as can be seen in FIG. 10, while a further blank Z is already moved into position so as to be folded inward into the next pair of folding claws 51 of the folding wheel 50 in the previously described manner.

Figure 11:
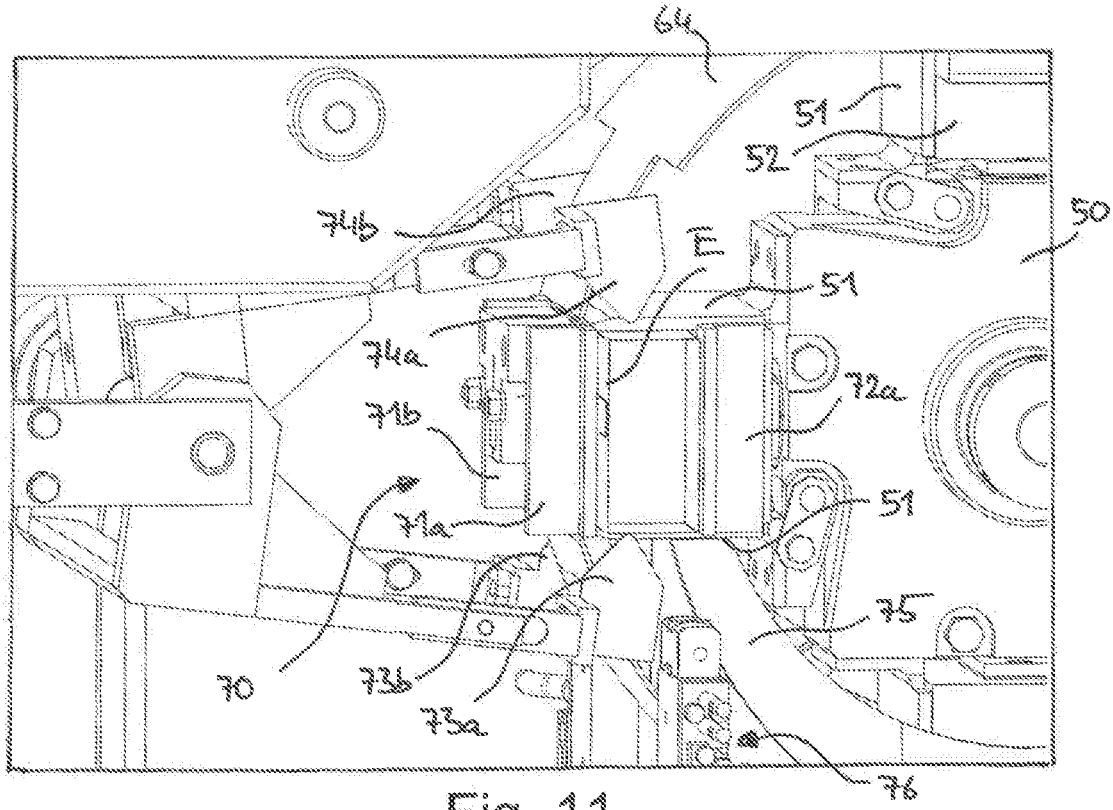

As soon as the second folding and connecting station 70 has reached the situation according to FIG. 11 and the folding wheel 50 has been brought to a temporary standstill, the transverse peripheries of the wrapper E that extend so as to be approximately perpendicular to the lateral longitudinal peripheries (already connected to one another) of said wrapper E and extend in each case between the two folding claws of the pair of folding claws 51 are now also folded in each case inward onto the pre-shaped product portion and simultaneously connected to one another.

Figure 12:
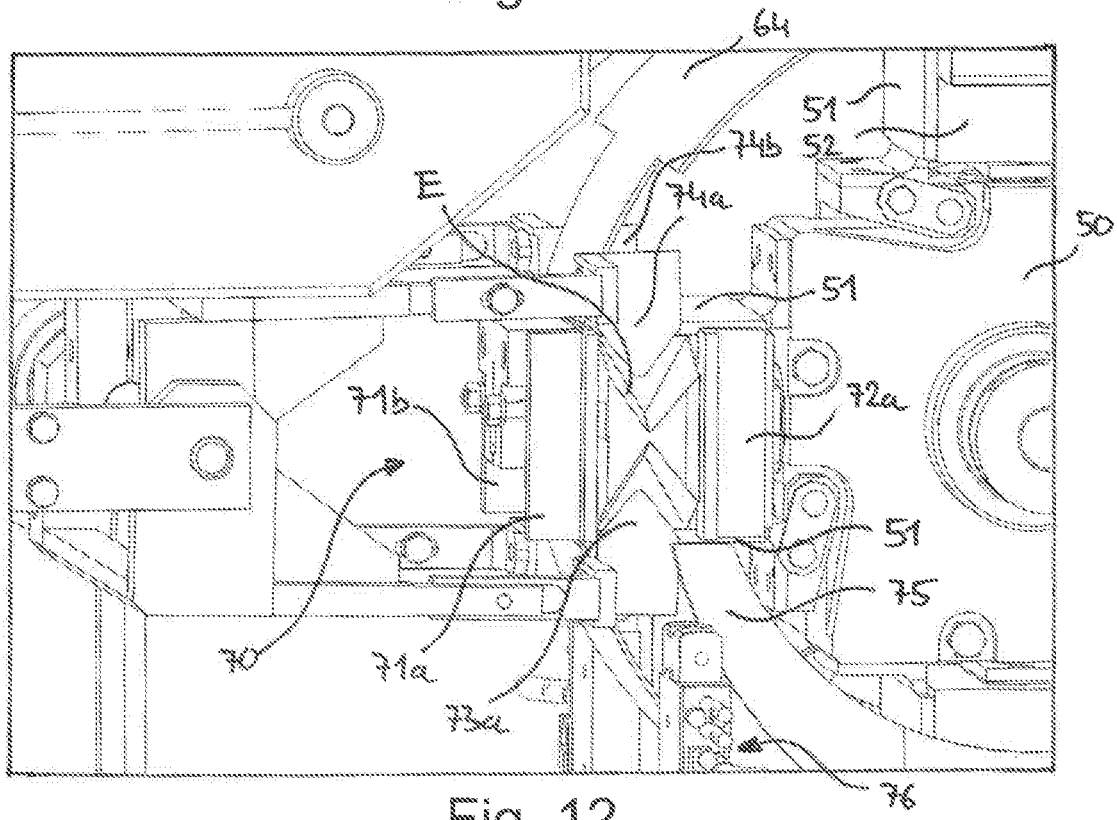
Figure 13:
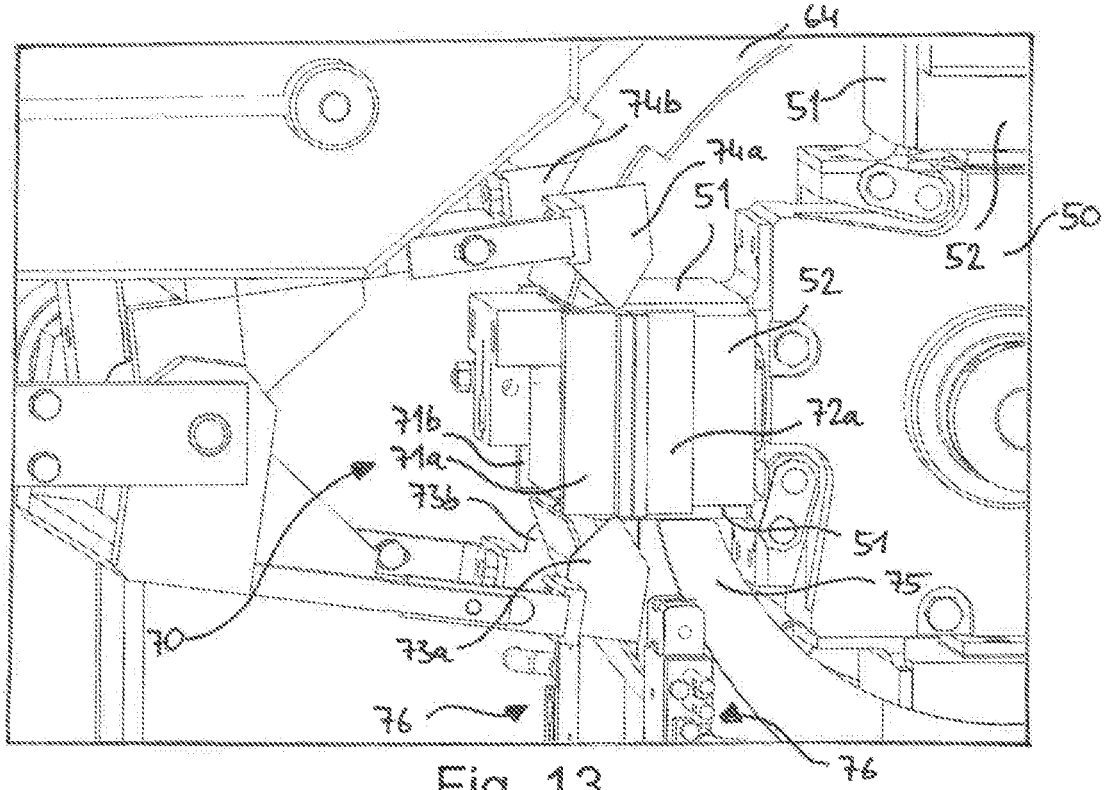

As can be seen in FIG. 12, in the exemplary embodiment shown this takes place in that the two opposite peripheral portions of the wrapper E that are situated between the transverse peripheries of said wrapper E (in each case at the top and bottom in FIG. 12) are initially folded in each case inward in a substantially triangular shape onto the product portion in that the third folding tools 73*a* and 74*a*, and 73*b* and 74*b*, respectively, of the second folding and connecting station 70 that are designed in the manner of so-called "penetrating folding units" are in each case converged, presently pivoted, from a resting position (see FIG. 14) to the folding position thereof according to FIG. 12. As is shown in FIG. 13, the third folding tools 73*a* and 74*a*, and 73*b* and 74*b*, respectively, are thereafter moved back in the direction of the resting position thereof (see FIG. 14), and the second folding and connecting tools 71*a* and 72*a*, and 71*b* and 72*b*, respectively, are converged so as to fold the transverse peripheries of the wrapper E in each case onto the peripheral portions of said wrapper E that are now folded inward in a substantially triangular shape, and to connect the transverse peripheries to one another. This takes place in a manner analogous to that explained above in detail with reference to the first folding and connecting tools 61, 62 of the first folding and connecting station 60, whereby a packaging material barrier can be dispensed with in this case, because the transverse peripheries of the wrapper E that are to be connected to one another, by virtue of the substantially triangular-shaped peripheral portions that have previously been folded inward and consequently are situated on the inside of the transverse peripheries to be connected to one another, are preloaded towards the outside and thus are not at risk of contacting one another at an inopportune time.

Once the second folding and connecting tools 71*a* and 72*a*, and 71*b* and 72*b*, respectively, have been moved out of the folding and connecting position thereof according to FIG. 13 and back to the resting position thereof according to FIG. 14, the folding wheel 50 is once again rotated by 90° so as to supply the wrapper E, which in the pair of folding claws 51 is now closed on all sides, to the calibrating station 80. As can be derived from FIGS. 14 and 15, the wrapper E that is provided with the pre-shaped product portion and is closed on all sides here first passes the cold adhesive application station 76 where two cold adhesive spots $P_1$, $P_2$ are applied to said wrapper E in the proximity of the now connected-together transverse peripheries which at this stage still project in a substantially perpendicular manner from a respective transverse side, for example. While the folding wheel 50 continues to be rotated by 90°, each of the transverse sides of the wrapper E provided with the cold adhesive spots $P_1$, $P_2$ comes into contact thereafter with the second turn-over units 75, so as to turn over the two transverse peripheries that are connected to one another and project from a respective transverse side onto a respective transverse side and fasten said transverse peripheries there by means of the cold adhesive spots $P_1$, $P_2$ (cf. FIG. 16).

As is derived from FIG. 17, the wrapper E, which is provided with the pre-shaped product portion and is closed on all sides, upon completion of the rotation of the folding wheel by 90°, reaches the calibrating station 80 where said wrapper E under a contact pressure against the compression plate (not visible) that by means of the piston/cylinder unit 81 is moved in the direction of the pair of folding claws 51 (likewise not visible in FIG. 17) is calibrated in a manner known per se.

The folding wheel 50 is thereafter yet again rotated by 90° in a counter-clockwise manner so as to transfer the completely calibrated wrapper packaging E to the delivery station 90 where the slide 92 in the situation according to FIG. 18 has just gripped the wrapper packaging E that is still situated in the pair of folding claws 51. The slide 92 is thereafter displaced along the guide rod 91 to the position reproduced in FIG. 19, in which said slide has removed the wrapper packaging E from the pair of folding claws 51 and transferred said wrapper packaging E to the parcel reverser 93. As is shown in FIG. 20, the parcel reverser 93 is thereafter pivoted so as to transfer the wrapper packaging E onto the conveyor belt 100 and to hand over said wrapper packaging E to a store (not shown), for example.

It goes without saying that the method steps described above with reference to the packaging of a single product portion can be repeated not only at a continuous sequence but that four wrappers can in particular be in each case processed in a synchronous manner, wherein simultaneously

- a blank is folded inward into a pair of folding claws 51 of the folding wheel 50 by placing a pre-shaped product portion, whereupon the lateral longitudinal peripheries of the wrapper are connected to one another at the first folding and connecting station 60;
- the transverse peripheries of a further wrapper, which has already passed this stage, are connected to one another in the next pair of folding claws 51 of the folding wheel 50 at the second folding and connecting station 70;
- a further wrapper, which has already passed this stage, is calibrated in the next pair of folding claws 51 of the folding wheel 50 at the calibrating station 80; and
- a further wrapper, which has already passed this stage, is transferred from the next pair of folding claws 51 of the folding wheel 50 to the conveyor belt 100 at the transfer station 90.

Figure 21:
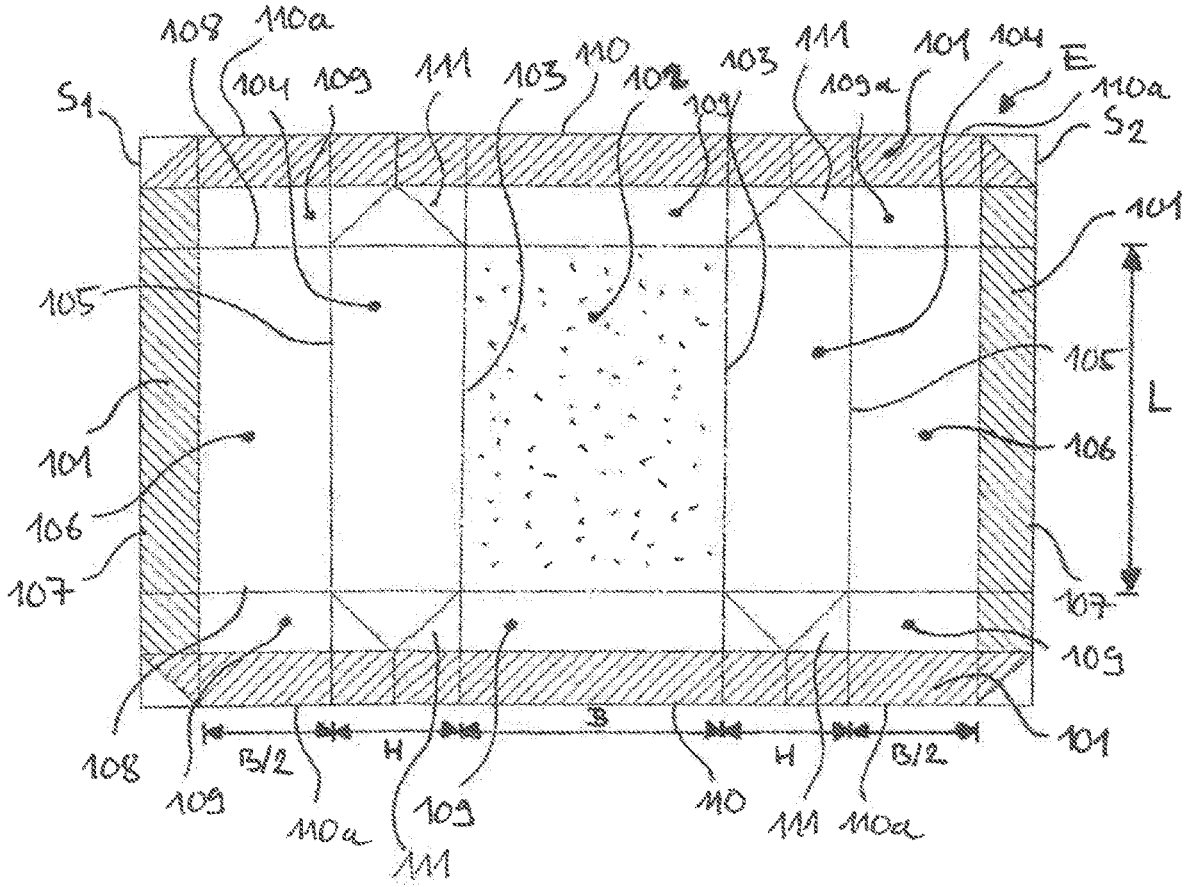
FIG. 21 shows a schematic plan view of a cut-away drawing of a wrapper generated by means of the packaging machine according to FIGS. 1 to 20, so as to visualize the folding and connecting lines of said wrapper.

A front elevation or plan view, respectively, of a wrapper E generated by means of the packaging machine 1 according to FIGS. 1 to 19 is schematically reproduced in FIG. 21 for visualizing the folding and connecting lines of said wrapper E. The length of the wrapper packaging is identified by the reference sign L, the width thereof by the reference sign B, and the height thereof by the reference sign H. The peripheries of the wrapper E to the right and the left in FIG. 21 correspond to the cutting lines $S_1$, $S_2$ along which a planar blank Z of the wrapper E has been cut to length from the packaging material web 4 by means of the cutting installation (cf. FIGS. 1 to 20 above). The peripheral regions 101 illustrated in dashed lines correspond to the pattern of cold adhesive that has been previously applied locally to the packaging material web 4.

The central area 102 of the wrapper E illustrated by dots covers the base area of the product portion which, conjointly with the ejection of a product portion from a product-forming duct 11 of the pre-shaping installation 10, has been folded onto the base 52 of a pair of folding claws 51 of the folding wheel. The folding lines 103 adjoin the base area 102 to the right and the left in FIG. 21, said folding lines 103 having likewise been generated when folding a blank Z of the wrapper E into the pair of folding claws 51 between the base 52 and a respective folding claw of the pair of folding claws 51. The folding lines 103 consequently extend between the base area 102 and a respective longitudinal lateral area 104 which, when folding a blank Z of the wrapper E into the pair of folding claws 51 bears on the internal side of a respective folding claw. The folding lines 105 which extend parallel to the folding lines 103 are situated on the side of a respective longitudinal lateral area 104 that is opposite a respective folding line 103, said folding lines 105 having been generated by means of the first folding and connecting tools 61, 62 of the first folding and connecting station 60 when the portions 106 which in each case outwardly adjoin said folding lines 105 and in each case cover approximately half the upper side of the completely packaged product portion, by way of the lateral longitudinal peripheries 107 of said portions 106, have been folded inward onto the product portion, whereby the regions 101 of the lateral longitudinal peripheries 107 that are provided with the cold adhesive coating have simultaneously been cold-sealed to one another.

Furthermore, the folding lines 108 which extend so as to be perpendicular to the folding lines 103 and 105 adjoin the base area 102 of the wrapper E towards the top and the bottom in FIG. 21, the lower transverse lateral areas 109 of the wrapper packaging in turn adjoining the base area 102 towards the top and the bottom, while in each case approximately half of the upper transverse lateral areas 109*a* on both sides of the folding lines 108 adjoin in each case the portions 106 towards the top and the bottom, said portions 106 covering in each case approximately half the upper side of the completely packaged product portion. The lower transverse lateral areas 109 as well as in each case two halves of the upper transverse lateral areas 109*a* by means of the second folding and connecting tools 71*a*, 71*b*, 72*a*, 72*b* of the second folding and connecting station 70 have been folded inward onto the product portion, whereby the lower transverse peripheries 110 and the upper transverse peripheries 110*a* have simultaneously been cold-sealed to one another along the regions 101 of the transverse peripheries 110, 110*a* that are provided with the cold adhesive coating.

Furthermore to be seen in FIG. 21 are the peripheral portions 111 which by means of the third folding tools 73*a*, 73*b*, 74*a*, 74*b* of the second folding and connecting station 70 have been folded inward in an approximately triangular shape onto the product portion and which are situated between the transverse peripheries 110, 110*a* that are connected to one another, and in the completed wrapper packaging are disposed below or within, respectively, said transverse peripheries 110, 110*a*.

The invention claimed is:

1. A packaging machine for packaging portioned products which are liquid or pasty at least in a processing state in a wrapper that is cut to length from at least one packaging material web, comprising:

a metering installation which is configured for metering a product portion of the products which are liquid or pasty at least in the processing state;

a pre-shaping installation which is integrated in the metering installation or disposed downstream thereof, and which is configured for pre-shaping the metered product portion so as to form a pre-shaped product portion;

a transport installation which is configured for transporting the at least one packaging material web in a direction of the pre-shaping installation;

a cutting installation which is cooperating with the transport installation and in a transporting direction thereof is disposed upstream of the pre-shaping installation and which is configured for cutting to length a substantially planar blank of a wrapper from the at least one packaging material web;

an upwardly open pair of folding claws which are cooperating with the pre-shaping installation and disposed downstream of the cutting installation;

a guiding installation which is configured for transferring the substantially planar blank of the wrapper that by the cutting installation has been cut to length from the at least one packaging material web to a position above the upwardly open pair of folding claws;

a first folding station which is configured for folding lateral longitudinal peripheries of the wrapper which is upwardly open provided with the pre-shaped product portion inward onto the pre-shaped product portion; and a second folding station which is disposed downstream of the first folding station and is configured for folding transverse peripheries of the wrapper which extend so as to be substantially perpendicular to the lateral longitudinal peripheries of said wrapper inward onto the pre-shaped product portion;

wherein the first folding station is configured as a first folding and connecting station and has two first folding and connecting tools which are able to move toward each other until the two first folding and connecting tools exert a contact pressure on each other and are able to move away from each other;

wherein the upwardly open pair of folding claws and the first folding and connecting station are able to be moved relative to one another to a first folding and connecting position in which the first folding and connecting station is situated directly above the upwardly open pair of folding claws so as to, by relocating the two first folding and connecting tools towards one another in a manner substantially parallel to an open upper side of the upwardly open pair of folding claws, under a first contact pressure fold the lateral longitudinal peripheries of the upwardly open wrapper provided with the pre-shaped product portion and situated in the upwardly open pair of folding claws inward onto the pre-shaped product portion and simultaneously connect said lateral longitudinal peripheries to one another;

wherein the guiding installation has a first pair of first guides which are disposed so as to be mutually parallel, as well as a second pair of second guides which are disposed so as to be mutually parallel;

wherein the first pair of the first guides is disclosed directly downstream of the cutting installation that is disposed downstream of the transport installation so as to receive therebetween the substantially planar blank of the wrapper that by the cutting installation has been cut to length from the at least one packaging material web;

wherein the second pair of the second guides adjoins the first pair of the first guides so as to guide onward the substantially planar blank of the wrapper from the first pair of the first guides to the second pair of the second guides;

wherein the first pair of the first guides terminate at a position above the upwardly open pair of folding claws, and the second pair of the second guides is able to be moved in a reciprocating manner between a first position, in which the second pair of the second guides adjoins the first pair of the first guides and in this way bridges the upwardly open pair of folding claws, and a second position, in which the second pair of the second guides is disposed at a spacing from the first pair of the first guides that leaves vacant an open cross section of the upwardly open pair of folding claws;

wherein a first one of the first folding and connecting tools of the first folding and connecting station is disposed on the first pair of the first guides of the guiding installation, and in that a second one of the first folding and connecting tools of the first folding and connecting station is disposed on the second pair of the second guides of the guiding installation that are able to be moved in a reciprocating manner, such that said second one of the first folding and connecting tools, conjointly with the second pair of the second guides of the guiding installation, is able to be moved toward and away from the first one of the first folding and connecting tools.

2. The packaging machine according to claim 1, wherein the second folding station is configured as a second folding and connecting station and has two second folding and connecting tools which are disposed on opposite open transverse sides of the upwardly open pair of folding claws and which are able to move toward each other until the two second folding and connecting tools exert a second contact pressure on each other and are able to move away from each other, wherein the upwardly open pair of folding claws and the second folding and connecting station are able to be moved relative to one another to a second folding and connecting position in which the upwardly open pair of folding claws that are open in a direction of two transverse sides of the pre-shaped product portion situated in the upwardly open pair of folding claws are situated in an interior of the second folding and connecting station so as to fold the lateral transverse peripheries of the wrapper situated in the upwardly open pair of folding claws and provided with the pre-shaped product portion inward onto the pre-shaped product portion and simultaneously connect said lateral transverse peripheries to one another.

3. The packaging machine according to claim 2, wherein the upwardly open pair of folding claws is disposed on an external circumference of a rotatingly driven folding wheel, wherein the first folding and connecting station and the second folding and connecting station are disposed on different circumferential regions of the folding wheel.

4. The packaging machine according to claim 3, comprising a plurality of pairs of folding claws, and the plurality of pairs of folding claws are disposed on different circumferential regions of the folding wheel, wherein circumferential spacing between two neighboring pairs of folding claws corresponds to circumferential spacing between the first folding and connecting station and the second folding and connecting station.

5. The packaging machine according to claim 4, wherein the pre-shaping installation is disposed on a same circumferential region of the folding wheel as the first folding and connecting station.

6. The packaging machine according to claim 2, wherein the second folding and connecting station furthermore has two third folding tools which are able to be moved toward each other and away from each other in a direction which is parallel to a respective plane of movement of the second folding and connecting tools but substantially perpendicular to a direction of movement of the latter so as to, when folding the transverse peripheries of the wrapper onto the pre-shaped product portion and connecting these transverse peripheries to one another by the second folding and connecting tools, first fold inward in a substantially triangular shape two opposite peripheral portions of the wrapper that are situated between the transverse peripheries of the latter onto the product portion and thereafter by the second folding and connecting tools fold the transverse peripheries of the wrapper outward onto the peripheral portions of the wrapper that have been folded inward in the substantially triangular shape and simultaneously connect said transverse peripheries to one another.

7. The packaging machine according to claim 2, wherein: the first folding and connecting tools of the first folding and connecting station and/or the second folding and connecting tools of the second folding and connecting station are formed by sealing tools.

8. The packaging machine according to claim 1, wherein the pre-shaping installation:

has a product-forming duct which is integrated in the metering installation and has a product ejector ram which is configured for ejecting the pre-shaped product portion into the upwardly open pair of folding claws, wherein the guiding installation is disposed between the product-forming duct and the upwardly open pair of folding claws so as to, when the product portion that has been pre-shaped in the product-forming duct by the product ejector ram is ejected from the product-forming duct into the upwardly open pair of folding claws, simultaneously fold the blank of the wrapper which by the guiding installation has been introduced into an intermediate space between the product-forming duct and the upwardly open pair of folding claws into the upwardly open pair of folding claws; or is formed by a forming nozzle which is disposed downstream of the metering installation and which is configured for ejecting the pre-shaped product portion into the upwardly open pair of folding claws, wherein the guiding installation is disposed between the forming nozzle and the upwardly open pair of folding claws so as to, when the product portion that has been pre-shaped in the forming nozzle is ejected into the upwardly open pair of folding claws, simultaneously fold the blank of the wrapper which by the guiding installation has been introduced into an intermediate space between the forming nozzle and the upwardly open pair of folding claws into the upwardly open pair of folding claws.

* * * * *